US005674063A

United States Patent [19]

Ozaki et al.

[11] Patent Number: 5,674,063

[45] Date of Patent: Oct. 7, 1997

[54] SCREW FLUID MACHINE AND SCREW GEAR USED IN THE SAME

[75] Inventors: Masayuki Ozaki, Yotukaidou; Isao Akutsu, Chiba, both of Japan

[73] Assignee: Diavac Limited, Chiba-Ken, Japan

[21] Appl. No.: 516,283

[22] Filed: Aug. 17, 1995

[30] Foreign Application Priority Data

Aug. 19, 1994 [JP] Japan ..... 6-218163

[51] Int. Cl.[6] ..... F01C 1/16

[52] U.S. Cl. ..... 418/201.3; 418/3; 418/9; 418/150; 74/458

[58] Field of Search ..... 418/3, 9, 10, 150, 418/201.3; 74/458, 424.7, 462, 466

[56] References Cited

U.S. PATENT DOCUMENTS

| | | | |
|---|---|---|---|
| 2,652,192 | 9/1953 | Chilton . | |
| 3,807,911 | 4/1974 | Caffrey | 418/9 |
| 4,782,802 | 11/1988 | Koromilas . | |

FOREIGN PATENT DOCUMENTS

| | | | |
|---|---|---|---|
| 789211 | 10/1935 | France . | |
| 1500160 | 1/1968 | France . | |
| 11511 | 1/1979 | Japan | 418/201.3 |
| 60-216089 | 10/1985 | Japan . | |
| 956840 | 9/1982 | U.S.S.R. | 418/201.3 |
| 419338 | 12/1934 | United Kingdom . | |

*Primary Examiner*—Charles G. Freay

*Attorney, Agent, or Firm*—Armstrong, Westerman, Hattori, McLeland & Naughton

[57] ABSTRACT

In a screw fluid machine including male and female rotors which are engaged with each other, a casing for accommodating both the male and female rotors, fluid working rooms which are formed by the male and female rotors and the casing, and fluid inlet and outlet ports which are provided in the casing so as to intercommunicate with one end portion and the other end portion of the working rooms, the helix angle of the screw gear constituting each of the male and female rotors is set to be continuously varied in a helix advance direction. Further, the screw gear is designed so that the peripheral length of a pitch cylinder in a helix advance direction on a development of a tooth-trace rolling curve on the pitch cylinder of the screw gear can be expressed by a substantially monotonically increasing function.

1 Claim, 15 Drawing Sheets

SCREW FLUID MACHINE AND SCREW GEAR USED IN THE SAME

BACKGROUND OF THE INVENTION

1. Field of the Invention

The present invention relates to a screw fluid machine such as a screw-type pump, a screw-type compression pump, a screw-type motor or the like, and particularly to a screw vacuum pump which is suitably used in a low/medium vacuum range from the atmospheric pressure to $10^{-4}$ Torr level in vacuum degree, and also relates to a screw gear which is suitably used for the screw pump or the like.

2. Description of the Related Art

Various types of vacuum pumps such as an oil-sealed rotary vacuum pump, a Roots pump, a diffusion pump, etc. have been hitherto used in a low/middle vacuum range.

For example, in a manufacturing field for semiconductors, wafers are subjected to a predetermined treatment while placed in a chamber which is kept in a vacuum state. In this treatment, the chamber is evacuated by a vacuum pump while supplied with inert gas such as $N_2$ gas or the like to remove impurities ($O_2$, $CO_2$, etc.) in the chamber, and finally the chamber is kept in a vacuum state from several Torr to $10^{-4}$ Torr level. An oil-sealed rotary vacuum pump, a Roots type mechanical booster pump or the like has been utilized as a vacuum pump used in the above semiconductor manufacturing process.

However, the oil-sealed rotary vacuum pump has a disadvantage that lubricant oil used in this pump is liable to be contacted with various kinds of gas (for example, arsenic, gallium, chlorine, Poly-Si, fluorine, etc.) which are used as reaction gas in the semiconductor manufacturing process, resulting in reduction of the lifetime of the lubricant oil. In addition, it has another disadvantage that a semiconductor manufacturing chamber is contaminated by oil molecules, and this contamination adversely affects the semiconductor manufacturing process.

Furthermore, this type of pump has a narrower pressure range in which it can work normally, and thus several kinds of pumps must be successively used until a desired pressure (vacuum state) is obtained. Therefore, it cannot be performed using only one vacuum pump to evacuate the chamber from the atmospheric pressure to $10^{-4}$ Torr level.

In order to solve the above problem, an oil-free screw vacuum pump as disclosed in Japanese Laid-open Patent Application No. Sho-60-216089 has been proposed.

This type screw vacuum pump as disclosed in the above publication is of an oil-free type, and it can cover the above pressure range using only one pump.

The screw type vacuum pump as described above will be briefly described hereunder with reference to FIGS. 1 and 2.

FIG. 1 is a cross-sectional view showing a screw-type vacuum pump which corresponds to a plan view, and FIG. 2 is a cross-sectional view showing the screw-type vacuum pump of FIG. 1 which corresponds to a side view. As shown in FIGS. 1 and 2, a male rotor 10 and a female rotor 11 are freely rotatably supported through bearings 14, 15, 16 and 17 in a main casing 12 and a suck-in casing 13, and each of the male rotor 10 and the female rotor 11 comprises a screw gear (screw). The screw gear has a fixed helix angle of tooth trace at all times, and further it has a fixed tooth-trace pitch in its rotation-axis direction (hereinafter referred to as "tooth pitch of rotational axis") and a fixed tooth-trace pitch on the plane of rotation which is vertical to the rotation axis (hereinafter referred to as "tooth pitch of rotational plane").

Therefore, these pitches are not varied in accordance with variation of the rotational angle of the rotors 10 and 11.

In FIGS. 1 and 2, a suck-in side 10*a* of the rotors is kept at a low pressure of $10^{-4}$ Torr level while a discharge side 10*b* of the rotors is kept at the atmospheric pressure, so that a radial load imposed on the rotors is extremely smaller at the suck-in side than the discharge side. Therefore, the bearings 14 and 15 of the suck-in side are designed to support a radial load and a thrust load with deep groove ball bearings, and the bearings 16 and 17 at the discharge side are designed to support only a radial load with cylindrical roller bearings.

Timing gears 18 and 19 are secured to the shaft ends of the rotors 10 and 11 to adjust the gap interval between the male and female rotors 10 and 11 so that these rotors do not come into contact with each other.

Lubrication of the bearings 14 and 15 is performed by oil splash. That is, lubricant 21 stocked in a suck-in cover 20 is splashed to the bearings 14 and 15 by the timing gears 18 and 19. Likewise, lubrication of the bearings 16 and 17 is also performed by a disc 22 which is secured to the shaft of the male rotor. That is, lubricant 24 stocked in a discharge cover 23 is splashed to the bearings 16 and 17 by the disc 22. Furthermore, shaft seals 25, 26, 27 and 28 are provided to prevent leakage of the lubricant of the bearings and timing gears into working rooms, Since substantially the atmospheric pressure is kept in a working room 10*b* at the discharge side of the rotors and in the discharge cover 23, so that the differential pressure acting on the shaft seals 27 and 28 at the discharge side is relatively small. On the other hand, since a working room at the suck-in side is kept at a pressure of $10^{-4}$ Torr level, the differential pressure acting on the suck-in side shaft seals 25 and 26 becomes large when the inside of the suck-in cover 20 is released to the atmospheric air, so that it is difficult to keep a seal effect at the suck-in side. Accordingly, in order to enhance the sealing effect, the inside of the suck-in cover 20 is designed to intercommunicate with a low-pressure working room 10C through exhausting pipes 29 and 30 to reduce the pressure in the suck-in cover 20 and thus reduce the differential pressure acting on the shaft seals 25 and 26.

Furthermore, the splashed oil is filled in the suck-in cover 20 as described above, and thus in order to prevent the splashed oil from back-diffuse the exhausting pipes 29 and 30 into the working rooms, a splash separation room 31 is provided in the suck-in cover 20 and an oil trap 32 is also provided in the exhausting pipe 30.

Even if the oil leaks through the exhausting pipes 29 and 30 into the working rooms, a exhausting port 34 of the main casing 12 is disposed to be opened to (intercommunicate with) the working room 10C at such a position that the working room 10*c* of the rotor 10 is perfectly closed from a suck-in port 33, thereby preventing the oil from counter-flowing into the suck-in port 33.

The working room 10*c* of the male rotor 10 has two engaging portions 36 and 37 which are engaged with the female rotor 11 during a period from the time when the working room 10*c* passes over the suck-in port 33 until it intercommunicates with a discharge port 35, and likewise a working room 11*c* of the female rotor 11 has two engaging portions 38 and 37 which are engaged with the male rotor during this period.

By rotation of the rotors, gas is sucked into the working rooms which are formed by the tooth grooves of the rotors and the casing, and then discharged from the discharge port 35.

In the screw-type vacuum pump thus constructed, through the rotation of the rotors, the working rooms 10*c* and 11*c* serve to feed suck-in gas to the discharge port side while keeping their volume constant. On the other hand, through the rotation of the rotors, the working rooms 39 and 40 located at a position where the rotors further rotate (i.e., which is nearer to the discharge port) serve to feed the gas to the discharge port while compressing the suck-in gas by reducing their volume.

Next, an engagement state between the male rotor 10 and the female rotor 11 will be described with reference to FIG. 3.

FIG. 3 is a schematic diagram showing an engagement state between the male rotor 10 and the female rotor 11, which is illustrated on a development in a peripheral direction of the rotors. As shown in FIG. 3, the casing 12 covering the rotors has a large opening portion as the gas suck-in port 33 at one end thereof in its axial direction, and also has an opening portion as the discharge port 35 at the other end thereof. At the portions other than these opening portions, the casing 12 covers the rotors 10 and 11 while keeping a minute gap between the casing and each of the rotors 10 and 11, and V-shaped working rooms are formed by the rotors 10 and 11 and the casing 12.

When the rotors 10 and 11 are rotated, the engaging portion of the rotors 10 and 11 is moved from the suck-in port 33 to the discharge port 35. At this time, a working room 41 reduces its volume and thus compresses the gas therein. On the other hand, a working room 42 keeps its volume, so that the working room 42 has no compressing action on the gas, but has only a gas feeding action.

That is, each of the male rotor 10 and the female rotor 11 is formed of a screw gear in which the tooth-trace helix angle is constant, and also the pitch of rotation axis and the pitch of rotation plane are fixed, so that the volume of the V-shaped working room 42 which is formed by the rotors and the casing is fixed.

On the other hand, when the rotors are rotated and the engaging portion of the rotors is moved from the suck-in port 33 to the discharge port 35, the volume of the working room 41 is reduced by an end plate 12*a* of the casing 12. Accordingly, the working room 41 acts to reduce its volume and feed the gas while compressing the gas therein. On the other hand, the working room 42 has no compression action on the gas because the volume thereof is constant at all times, and it acts merely to feed the gas.

In FIG. 3, the gas is discharged from the working room 43 through the discharge port 35. On the other hand, each working room which intercommunicates with the suck-in port 33 increases its volume through the rotation of the rotors, so that it has a gas suck-in action. The screw fluid mechanism thus constructed is also usable as a compression pump, and further used as a motor.

As described above, the above conventional screw fluid machine, which is used as a vacuum pump or the like, has working rooms for compressing fluid (gas) by decreasing its volume and working rooms which have no compression action on the fluid, but has merely a fluid feeding action. Therefore, in the conventional screw vacuum pump, the pressure rises up locally (at the portion which has the compression action), and this local rise-up of the pressure causes an abnormal temperature increase at parts of the rotors and the casing of the vacuum pump. That is, the temperature at the discharge side at which the working room reduces its volume and thus compresses the gas tends to abnormally rise up as indicated by a dotted line in FIG. 8. As a result, the member constituting the screw vacuum pump are ununiformly thermally expanded due to the local temperature increase, and thus the dimensional precision of the gap between the casing and the rotors and the engaging portion's gap between the male rotor and the female rotor cannot be set to a high value.

Furthermore, a pumping speed characteristic of the conventional screw vacuum pump as described above is represented by a dotted line of FIG. 13. As is apparent from FIG. 13, the conventional screw vacuum pump attains the lowest pressure of $10^{-4}$ Torr level, however, the pumping speed is reduced in a vacuum range from $10^{-2}$ Torr to a high vacuum side. Accordingly, the conventional screw vacuum pump needs an extremely long evacuation time to attain the pressure of $10^{-2}$ Torr level, and thus it has been hitherto required to shorten the evacuation time.

Still furthermore, when the conventional screw fluid machine is used as a vacuum pump, the male rotor is first rotated by one motor, and then the female rotor is rotated through the timing gears, so that a lead to rotate the female rotor is imposed on the timing gears. Therefore, when the rotor is rotated at a high speed, noise occurs due to engagement between the timing gears, so that a working environment becomes worse.

Still furthermore, in another conventional screw vacuum pump, pressure adjustment devices 50 as shown in FIG. 4 are provided on the lower surface of the casing 12 and in the axial direction of the rotors in order to prevent excessive rise-up of the pressure of the working rooms and thus prevent the abnormal temperature rise-up of the vacuum pump when the vacuum pump works in a state where the suck-in pressure is substantially equal to the atmospheric pressure.

As shown in FIG. 5, the pressure adjustment device includes a discharge port 52 provided to the lower portion of the casing 12, a valve rod 53 for opening and closing the discharge port 52, a spring 54 for supporting the dead weight of the valve rod 53, a valve box 55 for accommodating the valve rod 53 and the spring 54, and an air open port 56 for discharging to the outside the gas discharged from the discharge port 52 which is formed in the valve box 55. An O-ring is secured around the valve rod 53. When the pressure adjustment device 50 as shown FIG. 5 is disposed as shown in FIG. 4, in some cases a working room 51*a* and a working room 51*b* intercommunicate with each other through the discharge port 52 as shown in FIG. 5, and the gas flows from the working room 51*a* to the working room 51*b* in a direction as indicated by an arrow. That is, each addendum 58 of the rotors does not have sufficient width, so that there occurs a case where the discharge port 52 is located over both the neighboring working rooms 51*a* and 51*b*. As a result, the gas leaks from the high-pressure working room 51*a* to the low-pressure working room 51*b*, and thus it takes a long time to evacuate the suck-in side to a desired vacuum degree.

SUMMARY OF THE INVENTION

A first object of the present invention is to provide a screw fluid machine in which no local abnormal temperature increase occurs when it is used as a vacuum pump, a compression pump or the like, and also to provide a screw gear which is suitably used as a screw or the like of the screw fluid machine.

A second object of the present invention is to provide a screw fluid machine in which a stable pumping speed can be obtained in a working range from the atmospheric pressure (760 Torr) to $10^{-4}$ Torr when it is used as a vacuum pump.

A third object of the present invention is to provide a screw fluid machine which produces little noise even when a high-speed rotating operation is performed.

A fourth object of the present invention is to provide a screw vacuum pump in which increase in shaft torque due to excessive compression can be prevented, abnormal rise-up of temperature can be prevented and the pressure at the suck-in side can be reduced to a desired vacuum degree for a short time.

In order to attain the first object of the present invention, a screw fluid machine according to a first aspect of the present invention including male and female rotors which are engaged with each other, a casing for accommodating the male and female rotors, fluid working rooms which are formed by the male and female rotors and the casing, and fluid inlet and outlet ports which are provided in the casing so as to intercommunicate with one end portion and the other end portion of the working rooms respectively, is characterized in that the helix angle of a screw gear constituting each of the male and female rotors is set to be continuously varied in an helix advance direction.

When the fluid machine thus constructed is used as a vacuum pump or a compression pump, the volume of the V-shaped working rooms which are formed by the rotors and the casing is continuously reduced as the working rooms moves from the suck-in side (fluid inlet port) toward the discharge side (fluid outlet port) because the tooth-trace helix angle of the male and female rotors varies in accordance with the helix advance direction.

Accordingly, the working rooms which are formed by the male and female rotors and the casing have a suck-in action, a continuous compression and feeding action and a discharge action, that is, it is not equivalent to the conventional working rooms which have only a feeding action because its volume is fixed, so that the abnormal temperature rise-up due to the local increase of pressure can be prevented.

Furthermore, a screw gear which is most suitably used for the screw fluid machine as described above is characterized in that the rolling peripheral length of a pitch cylinder in a helix advance direction can be represented substantially by a monotonically increasing function on a development of a tooth-trace rolling curve on the pitch cylinder of the screw gear. With the screw gear, the sealing performance in the direction vertical to the rotation axis is improved, so that gas-tightness in the fluid working rooms is more excellent.

It is needless to say that the screw gear according to the present invention can be used as an ordinary transmission gear, and also it can effectively treat a load which varies in the axis direction with time because the helix angle of the screw gear varies with time through the rotation thereof.

In order to attain the second object of the present invention, a screw fluid machine according to a second aspect of the present invention including male and female rotors which are engaged with each other, a casing for accommodating the male and female rotors, fluid working rooms which are formed by the male and female rotors and the casing, and fluid inlet and outlet ports which are provided in the casing so as to intercommunicate with one end portion and the other end portion of the working rooms respectively, is characterized in that each of the male and female rotors is provided with a screw gear portion, and a Roots portion which is formed at at least one end portion of each screw gear portion.

When the screw fluid machine thus constructed is used as a vacuum pump, not only the screw portion has the pumping action through the rotation of the male and female rotors, but also the Roots portion provided at least one end side of the screw portion has the pumping action. Therefore, the stable pumping speed can be obtained in a working range from the atmospheric pressure (760 Torr) to $10^{-4}$ Torr while it is not reduced in the range from $10^{-2}$ Torr level to $10^{-4}$ Torr level. Furthermore, when the screw fluid machine thus constructed is used as a compressor, a high discharge pressure can be obtained.

In order to attain the third object of the present invention, a screw fluid machine according to a third aspect of the present invention includes male and female rotors which are engaged with each other, a casing for accommodating the male and female rotors, fluid working rooms which are formed by the male and female rotors and the casing, and fluid inlet and outlet ports which are provided in the casing so as to intercommunicate with one end portion and the other end portion of the working rooms respectively, is characterized that each of the male and female rotors is provided with a motor for driving each of the male and female rotors, an inverter for transmitting a driving alternating signal or a driving pulse signal to the respective motors and a controller for transmitting a control signal to perform a frequency-control operation on the inverter, thereby controlling the rotational number of the male and female rotors.

In the screw fluid machine thus constructed, when a control signal corresponding to a predetermined rotational number, that is, a control signal to control the frequency of the inverter is transmitted from the controller to the inverter, a driving alternating signal or a driving pulse signal having a predetermined frequency (reference frequency) is transmitted from the inverter in accordance with the control signal, and the motors $M_1$ and $M_2$ are driven at a prescribed rotational number in accordance with the driving alternating signal or the driving pulse signal.

Accordingly, since the male and female rotors are rotated by the motors $M_1$ and $M_2$ in synchronism with each other, the rotational number of the motors varies little even when the male and female rotors are rotated at a high speed, and a load imposed on the timing gears is also small, so that the noise due to the engagement of the timing gears can be suppressed.

In order to attain the fourth object of the present invention, a screw fluid machine according to a fourth aspect of the present invention including male and female rotors which are engaged with each other, a casing for accommodating the male and female rotors, fluid working rooms which are formed by the male and female rotors and the casing, and a pressure adjustment device for discharging suck-in gas confined in the working rooms from a discharge port under pressure through the rotation of the rotors and controlling the pressure in the working rooms so that the pressure does not exceed the atmospheric pressure, is characterized in that the pressure adjustment device includes discharge ports which are formed in a screw end face plate constituting a part of the casing, a discharge valve which is provided at the outside of the discharge ports and is opened when the pressure in the working rooms exceeds the atmospheric pressure or its peripheral value, and a tooth end face of each rotor for opening and closing the discharge ports, which closes the insides of the discharge ports in a state where the tooth end face is located at the discharge ports through the rotation of the rotors.

In the screw fluid machine thus constructed, the discharge valve of the pressure adjustment device closes the outside of the discharge port when the suck-in pressure is low and the pressure in the working rooms is lower than the atmospheric pressure or its peripheral value.

At this time, the inside of the discharge port is closed by the tooth end face of the screw gear constituting the rotor, and thus a working rooms does not intercommunicate with an adjacent working room even when the rotors are rotated, so that the gas leakage from a high-pressure working room side to a low-pressure working room side can be prevented and thus the pressure at the suck-in side can be evacuated to a desired vacuum degree for a short time.

In addition, when the pressure of the suck-in gas is higher and the pressure in the working rooms is higher than the atmospheric pressure or its peripheral value, the discharge valve of the pressure adjustment device is released, and the gas in the working rooms is discharged from the discharge port to the outside. Furthermore, when the suck-in pressure is reduced and the pressure in the working rooms does not reach the atmospheric pressure just before the working room intercommunicates with the discharge port, all the discharge ports of the pressure adjustment device are closed, and the gas in the working rooms is discharged from the discharge port under pressure without being discharged from the pressure adjustment device to the outside.

DETAILED DESCRIPTION OF PREFERRED EMBODIMENTS

Preferred embodiments according to the present invention will be described with reference to the accompanying drawings.

First, a screw fluid machine according to a first embodiment of the present invention, and a screw gear (screw) which is designed to have a continuously-varying helix angle and used in the screw fluid machine will be described with reference to FIGS. 6 and 7, in a case where the screw fluid machine is applied to a vacuum pump.

The inventors of this application has paid their attention to a technical idea that in place of the conventional working rooms which have an invariable volume and has only a gas feeding action with no gas compression action, all the working rooms are designed to be continuously reduced in volume and have a gas compression action.

In order to continuously reduce the volume of the working rooms, the tooth-trace helix angle of a screw gear constituting each of male and female rotors of a screw vacuum pump is set to vary in accordance with the rotational angle of each rotor to thereby vary the volume of V-shaped working rooms which are formed by the rotors and the casing.

Accordingly, the shape of the screw gear constituting each of the male and female rotors is the most important point, and thus the shape of the screw gear of the screw vacuum pump will be mainly described in the following description. The other construction of the screw vacuum pump of this embodiment is similar to that of the conventional screw vacuum pump, and thus the description thereof is omitted.

The screw gear used in the screw vacuum pump of this embodiment will be described with reference to FIGS. 6 and 7.

Figure 6:
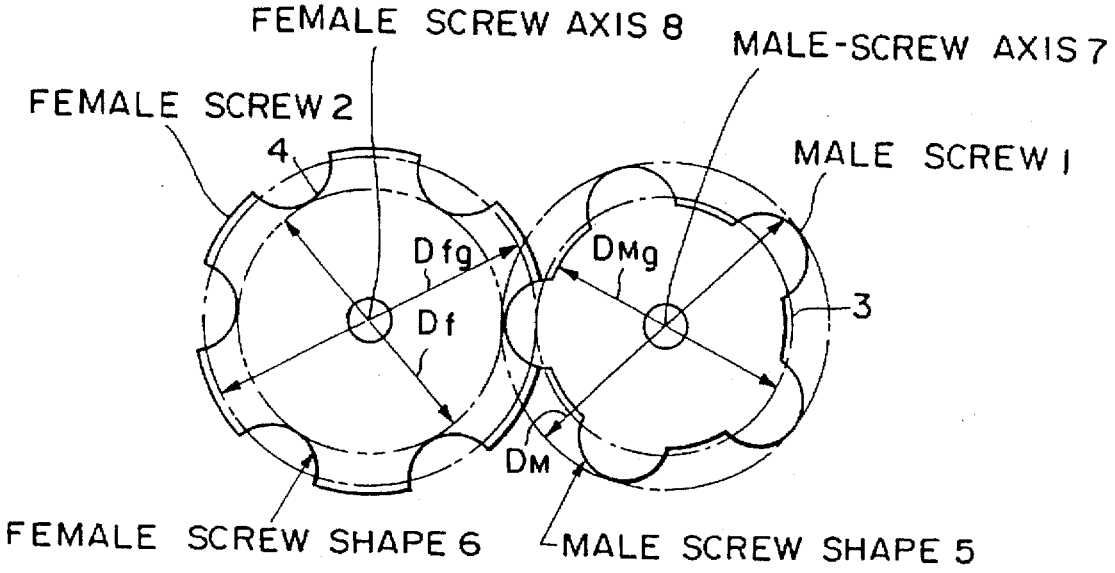
FIG. 6 is a plan view of a screw gear used in the present invention.
Figure 7:
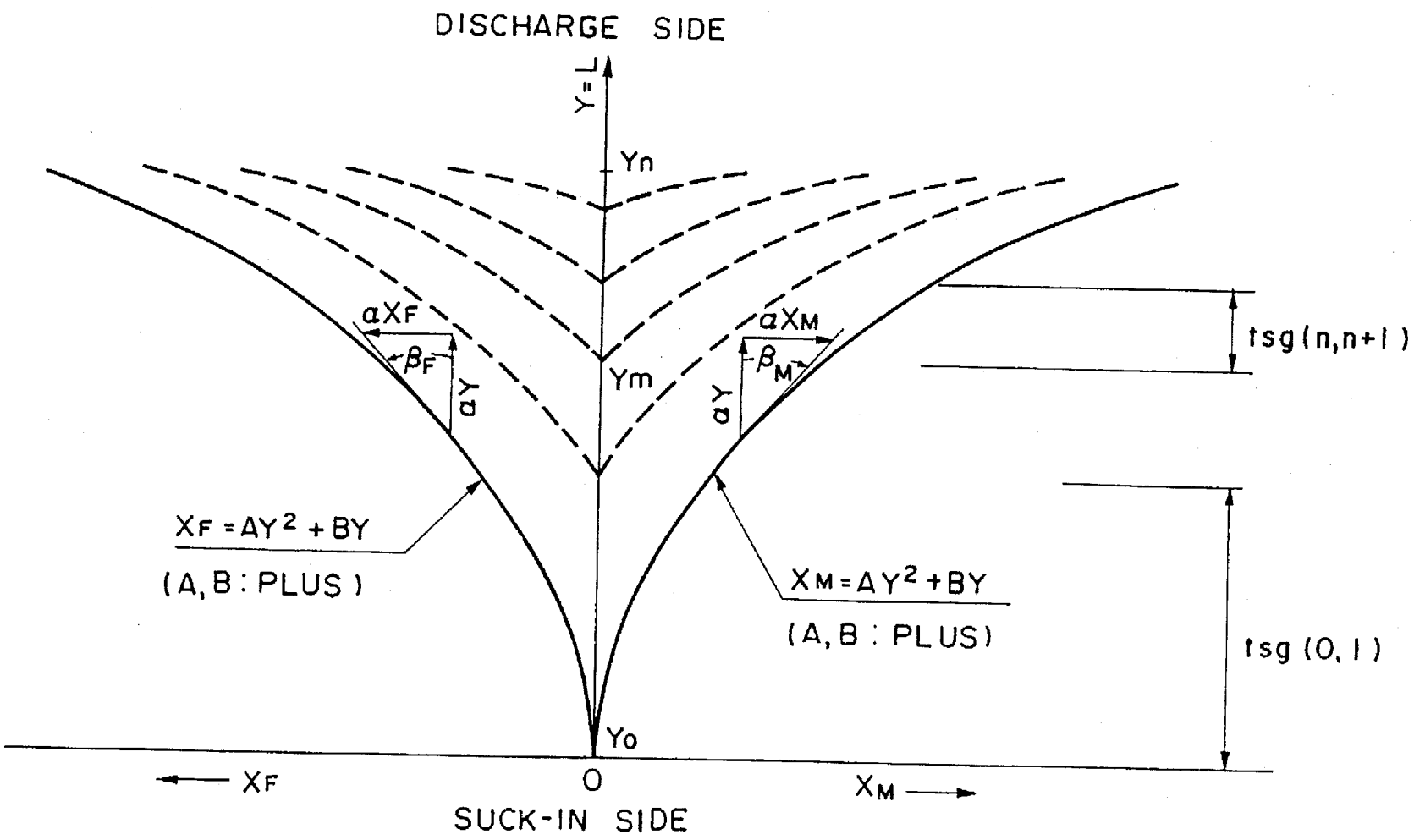
FIG. 7 is a development on an engagement pitch cylinder of the screw gear used in the present invention, which shows a tooth-trace rolling curve of a parabola (quadratic curve) on the coordinates in which the abscissa represents the male rolling peripheral length of the engagement pitch cylinder and the ordinate represents a helix advance amount.

FIG. 6 is a plan view showing the screw gear, and FIG. 7 is a development showing the tooth-trace rolling curve of each of the male and female screws. In FIG. 6, reference numeral 1 represents a male screw; 2, female screw; 5, male-teeth shaped portion; 6, female-tooth shaped portion; 7, male screw axis; and 8, female screw axis. In FIG. 7, the abscissa represents the rolling peripheral length $x_M$, $x_F$ of the male (female) screw on the pitch cylinder, and the ordinate represents the advance amount y of the screw in the rotation axis direction. The tooth-trace rolling curve of the male screw is represented on the $x_M$–y plane (at the right half side of FIG. 7), and the tooth-trace rolling curve of the female screw is represented on the $x_F$–y plane (at the left half side of FIG. 7). The sign of x ($x_M$ for the male screw, $x_F$ for the female screw) is set to be positive when the tooth trace is moved from the suck-in side to the discharge side when advancing along the tooth trace of the screw. That is, in FIG. 7, the right direction corresponds to the positive direction for the male screw, and the left direction corresponds to the positive direction for the female screw. The male screw is used for the male rotor, and the female screw is used for the female rotor.

In FIG. 7, at the position corresponding to the suck-in port of the rotors, y is equal to zero, and at the position corresponding to the discharge port, y is equal to L. The tooth traces of the male and female rotors on the respective pitch cylinders are coincident with each other at the suck-in port (y=0), and at this point it is assumed that $x_M=x_F=0$.

The tooth-trace rolling curve used in this specification is generally called as "helix".

No limitation is imposed on an effective range of x, y of FIG. 7. That is, the effective range of x is represented as follows:

$$x_M \geqq 0,\ x_F \geqq 0.$$

The effective range of y is determined by the length L of the rotors, and it is as follows:

$$0 \leqq y \leqq L.$$

On the development shown in FIG. 7, at the suck-in port (y=0), each of the tooth-trace rolling curves of the male and female rotors extends (starts) from the point (origin) at which the male and female rotors are contacted and coincident with each other on the pitch cylinder (that is, $x_M=0$ and $x_F=0$), and on both the curves, y increases as x increases. That is, for the male rotor, y is a monotonically increasing function of $x_M$, and for the female rotor, y is a monotonically increasing function of $x_F$.

This is equivalent to such a condition that x and y are interchanged with each other to regard y as an independent variable and regard x as a function of y. That is, for the male rotor, $x_M$ is regarded as a monotonically increasing function of y and represented as follows:

$$x_M=F_M(y) \tag{1}$$

For the female rotor, $x_F$ is regarded as a monotonically increasing function of y and represented as follows:

$$x_F=F_F(y) \tag{2}$$

Furthermore, since both the curves pass through the origin, $$F_M(0)=F_F(0)=0 \tag{3}$$

Here, in the following equations, parameters $\beta_{Mg}$, $\beta_{Fg}$, $\theta_M$ and $\theta_F$ which are defined as follows are introduced:

$\beta_{Mg}$: helix angle of the male rotor on the pitch cylinder $\beta_{Fg}$: helix angle of the female rotor on the pitch cylinder $\theta_M$: rotational angle of the male rotor $\theta_F$: rotational angle of the female rotor The helix angles $\beta_{Mg}$, $\beta_{Fg}$ corresponds to the angles shown in FIG. 7.

Furthermore, representing the radius of the pitch cylinder of the male (female) rotor by $R_M$ ($R_F$), the rotational angles $\theta_M$, $\theta_F$ are represented as follows:

$$\theta_M=x_M/R_M \tag{4}$$

$$\theta_F=x_F/R_F \tag{5}$$

Using the equations (1), (2), the helix angles $\beta_{Mg}$, $\beta_{Fg}$ of the male and female rotors are represented as follows:

$$\tan \beta_{Mg}=dx_M/dy=dF_M/dy \tag{6}$$

$$\tan \beta_{Fg}=dx_F/dy=dF_F/dy \tag{7}$$

The helix angles of the rotors are set to be continuously increased so that each fluid working room which is formed by the engagement of the male and female rotors is moved in a discharge direction of the vacuum pump while continuously reducing the volume of the working room. This is equivalent to an operation of continuously increasing $dF_M/dy$ and $dF_F/dy$ from the equations (6) and (7). That is, $F_M(y)$ and $F_F(y)$ which are given from the equations (1) and (2) pass through the origin. In addition, these functions are monotonically increasing functions of y and the differential coefficients thereof are also monotonically increasing functions. That is, in a variable range of y ($0 \leqq y \leqq L$), the functions $F_M(y)$ and $F_F(y)$ must satisfy the following equations:

$$F_M(0)=0,\ F_F(0)=0 \tag{8}$$

$$dF_M(fy)/dy>0,\ dF_F(y)/dy>0 \tag{9}$$

$$d^2F_M(y)/dy^2>0,\ d^2F_F(y)/dy^2>0 \tag{10}$$

That is, any function which satisfies the equations (8), (9) and (10): $x_M=F_M(y)$, $x_F=F_F(y)$ can be adopted as a development of the tooth-trace rolling curves of the male and female rotors.

As an engagement condition of the male and female rotors, the helix angles of the male and female screws on the pitch cylinder are required to be equal to each other in magnitude and opposite to each other in helix direction. However, according to an analysis which has been made until now, the positive directions of the rolling peripheral length $x_M$ and $x_F$ of the male and female rotors on the pitch cylinder are opposite to each other, so that the engagement condition of the male and female rotors must satisfy the following equation for all the values of y:

$$\beta_{Mg}=\beta_{Fg} \tag{11}$$

From the above equation, $$\tan \beta_{Mg}=\tan \beta_{Fg} \tag{12}$$

That is, from the equations (6) and (7), the following condition is obtained for all the values of y in the variable range:

$$dx_M/dy=dx_F/dy \tag{13}$$

From the equations (12) and (13), it is concluded that the function of $x_M=F_M(y)$ and the function of $x_F=F_F(y)$ are completely identical to each other. That is, it is concluded that the curve shown in FIG. 7 is symmetrical at right and left sides with respect to the y-axis. That is, when a helix-angle variable rotor is designed, any function F(y) which satisfies the following conditions is selected:

$$F(0)=0,\ dF/dy>0,\ d^2F/dy^2>0 \tag{14}$$

and using this function F(y), the following equations are set:

$$x_M=F_M(y),\ x_F=F_F(y) \tag{15}$$

Assuming that a plane-of-rotation pitch T on the pitch cylinder is equal between the male and female screws, and representing the tooth numbers of the male and female screws by $N_M$ and $N_F$ respectively, $$T=2\pi R_M/N_M=2\pi R_F/N_F \tag{16}$$

The development of a tooth-trace rolling curve of rotors having another tooth shape is obtained by parallel shifting x=F(y) in the x-axis direction by mT. Here, m represents a positive or negative integer. These curves are represented by dotted lines in FIG. 7.

As the simplest example, the following quadratic function can be selected as F(y):

$$F(y)=Ay^2+By\ (A>0,\ B>0) \tag{17}$$

The curve shown in FIG. 7 is an example of the quadratic curve as described above.

With respect to the helix-angle variable type screw gear thus specified, the development of the tooth-trace rolling curve on the pitch cylinder is given as any function satisfying the equation (14). Therefore, on the basis of variation of the gradient of the curve, the tooth-trace helix angle on the pitch cylinder is varied in accordance with the rotational angle of the screw, and further on the basis of the variation of the gradient of the curve, the tooth-shaped portion is determined in consideration of the basic technical idea of the tooth-trace helix angle of an existing helical gear or screw gear. The plane-of-rotation pitch T is made coincident on the pitch cylinders to perform an engagement, and the helix is advanced in the rotational-axis direction (y-direction) while the pitch $t_s$ of the rotational axis direction varies momentarily with variation of the rotational angle, but the engagement state and the tooth-shape status on the plane of rotation are kept.

That is, the rolling peripheral length and the helix advance direction amount on the pitch cylinders are equal between the male and female rotors, so that the length of the helix on each pitch cylinder is equal between the male and female rotors. That is, in any variable range of y [yi, yj], $$\int_{yi}^{yj} (dx_F^2+dy^2)^{1/2} = \int_{yi}^{yj} (dx_M^2+dy^2)^{1/2} \tag{A}$$

From the equation (A), the length of the helix on each pitch cylinder in the variable range [yi,yj] is equal between the male and female screws to perform the engagement of both the screws.

Furthermore, the tooth-trace rolling curve is also expressed by a function of the rotational angle, and the rotational angle and the tooth-trace rolling amount are proportional to each other. The length of the helix at the diameters $R_M'$ and $R_F'$ other than the pitch diameters of the male and female tooth-shaped portions can be obtained by replacing the $x_M$ and $x_F$ in the equation (A) with the following equations using the equations (4) and (5):

$$x'_M=x_M R_M'/R_M \quad x'_F=x_F R_F'/R_F$$

Accordingly, the equation (A) is not satisfied at the contact portion of the diameter other than that of the pitch cylinder, and it is adjusted by slip. That is, the following equation is satisfied:

$$\int_{yi}^{yj} (dx'_F{}^2+dy^2)^{1/2} + (\text{slip amount}) = \int_{yi}^{yj} (dx'_M{}^2+dy^2)^{1/2} \tag{A}$$

In order to enable the engagement between the male and female rotors, the following relationship must be satisfied between the rotational angles $\theta_M$ and $\theta_F$:

$$\theta_M N_F=\theta_F N_M \tag{18}$$

Here, $N_M$ and $N_F$ represent the number of teeth of the male and female rotors, respectively. Furthermore, the radius $R_M$, $R_F$ of the pitch cylinders of the male and female rotors has the following relationship:

$$R_M N_F=R_F N_M \tag{19}$$

Varying $\theta_M$, $\theta_F$ while keeping the equation (18), the following equation is satisfied at all times:

$$y_M(\theta_M)=y_F(\theta_F) \tag{20}$$

From the advance amount $y_M(\theta_M)$, $y_F(\theta_F)$, the pitch $t_s$ in the rotational axis direction can be given as a function of θ (θ may be $\theta_M$ or $\theta_F$ in consideration of the equation (20)). $t_s$ varies as y increases, and the pitch $t_{v-}$, $t_{v+}$ after and before the position of y(θ) are given as follows:

$$\begin{aligned} t_{V-} &= y_M(\theta_M)-y_M(\theta_M-2\pi/N_M) \\ &= y_F(\theta_F)-y_F(\theta_F-2\pi/N_F) \\ t_{V+} &= y_M(\theta_M+2\pi/N_M)-y_M(\theta_M) \\ &= y_F(\theta_F+2\pi/N_F)-y_F(\theta_F) \end{aligned} \tag{21}$$

Accordingly, pitches $t_{sg}$, $t_s$ (=$t_{sg}$) in FIG. 7 represent pitches at the engaging portion between both the rotors, and thus $t_{sg}$(n, n+1) and $t_s$(n, n+1) satisfy the following equations:

$$\begin{aligned} t_{sg}(n,n+1)&=y_M[2\pi(n+1)/N_M]-y_M(2\pi n/N_M) \\ t_s(n,n+1)&=y_F[2\pi(n+1)/N_F]-y_F(2\pi n/N_F) \end{aligned} \tag{22}$$

since the increasing rate dy/d of y(θ) is satisfied as follows, $$dy/d\theta=Rdy/dx=R/(dx/dy)=R/(dF/dy)$$

the increasing rate of y(θ) is inversely proportional to dF/dy, that is, the increasing rate gradually decreases as y increases. This means that the rotation-axis pitch gradually decreases as y increases, and $t_s$, $t_{sg}$ vary with keeping the following relationship:

$$t_s(n-1,n)>t_s(n,n+1),\ t_{sg}(n-1,n)>t_{sg}(n,n+1).$$

On the other hand, the plane-of-rotation pitch does not vary, so that the same tooth shape appears at all times through the rotation. That is, the volume which is kept in a hermetic state by the tooth-shaped portion of the male screw and the tooth-shaped portion of the female screw can be reduced with time by the movement which is caused by the rotation.

In the helix angle variable screw thus constructed, the tooth-trace rolling curve on the engagement pitch cylinder monotonically varies in its gradient as a monotonically increasing function. On the basis of the variation of the gradient of the tooth-trace helix curve, the variable tooth-trace helix angle on the pitch cylinder is determined, and on the basis of the variation of the gradient of the curve, the tooth-shaped portion is determined in consideration of the basic technical idea of the tooth-trace helix angle of an existing helical gear or screw gear. The plane-of-rotation pitch T is made coincident on the pitch cylinders to perform an engagement, and the helix is advanced in the rotational-axis direction Y(θ) while the pitch $t_{sg}$ of the rotational axis direction varies momentarily with variation of the rotational angle, but the engagement state and the tooth-shape status on the plane of rotation are kept. Therefore, the rotational angle and the tooth-trace rolling amount have a fixed relationship, so that the tooth shapes of a pair of male and female screws can be made coincident with each other on the plane of rotation. Accordingly, the same tooth at the initial state of the rotation appears on an n-th ($n_M$-th or $n_F$-th) plane of rotation which successively appears through the rotation around the rotational axis.

That is, the screw thus constructed has not only characteristics as an ordinary screw gear, but also characteristics as a screw having high sealing property on the plane of rotation. In addition, the rotation-axis pitch can be varied periodically and continuously.

Accordingly, when the male and female rotors are designed using this screw gear, the tooth-trace helix angles of the male and female rotors vary in accordance with the rotational angle of the rotors, so that the volume of the V-shaped working rooms formed by the rotors and the casing can be continuously varied. That is, all the working rooms can be designed so that the volume thereof is reduced.

Figure 8:
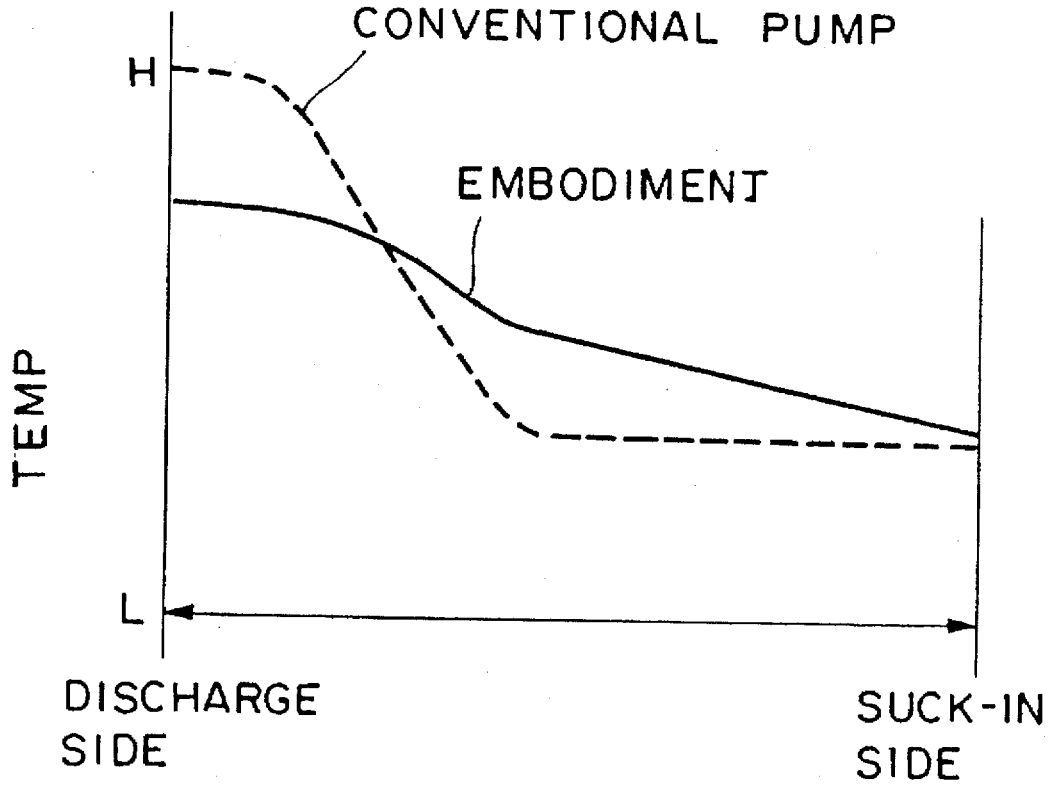
FIG. 8 is a diagram showing the rise-up of the temperature of the screw vacuum pump of the present invention and the conventional screw vacuum pump, in which a dotted line represents the conventional screw vacuum pump and a solid line represents the screw vacuum pump of a first embodiment of the present invention.

As described above, when a screw vacuum pump or a compression pump is constructed with the screw gear as described above, the volume of the working rooms varies continuously to perform a continuous compression and feeding action, so that the temperature of the pump gradually increases from the suck-in side to the discharge side, as indicated by a solid line of FIG. 8, and there occurs no local rise-up in temperature.

Furthermore, each working room has a suck-in action for sucking gas into the working room in a state where it intercommunicates with the suck-in port, a continuous gas compressing and feeding action for continuously compressing and feeding the gas in the working room, and a discharge action for discharging the gas to the outside in a state where it intercommunicates with the discharge port (that is, it has no mere feeding action), so that the screw vacuum pump can be effectively operated.

Still furthermore, since the rotation-axis pitch is variable, the total length of the rotors can be more shortened as compared with the conventional screw fluid machine using the fixed rotation-axis pitch, so that the screw fluid machine can be designed in a compact size.

Next, another embodiment in which a Roots portion is provided at least one end side of each screw portion of the male and female rotors in the screw fluid machine of the present invention will be described with reference to FIGS. 9 to 12.

Figure 9:
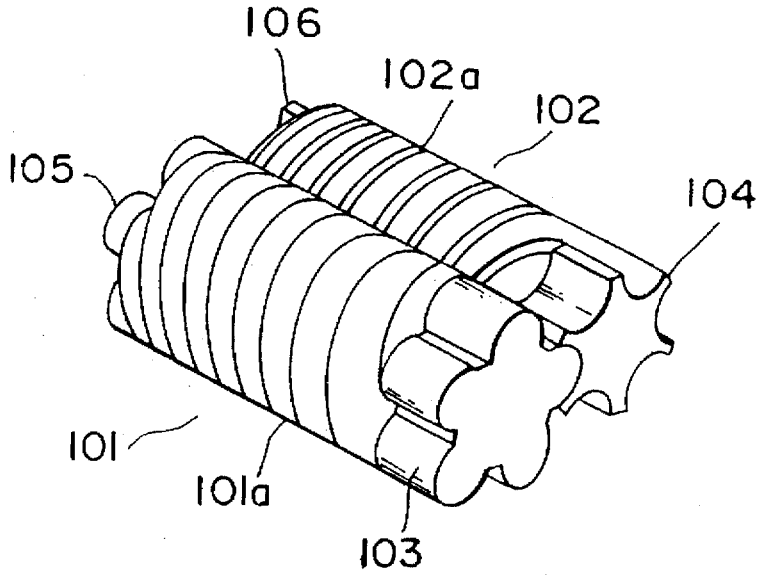
FIG. 9 is a perspective view showing male and female rotors which are used in the first embodiment of the present invention.
Figure 10:
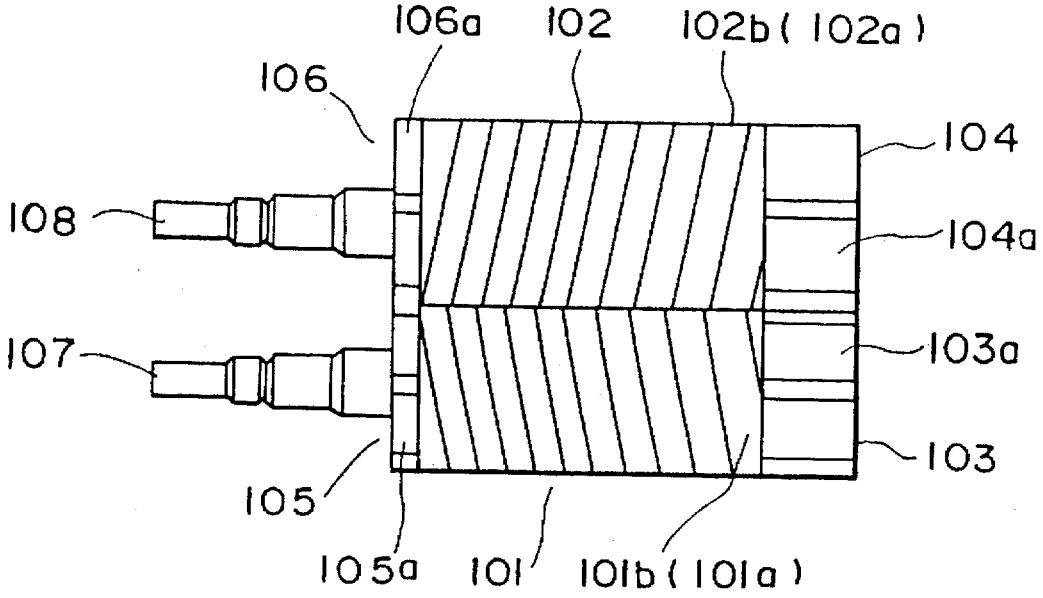
FIG. 10 is a plan view showing the male and female rotors of FIG. 9.
Figure 11:
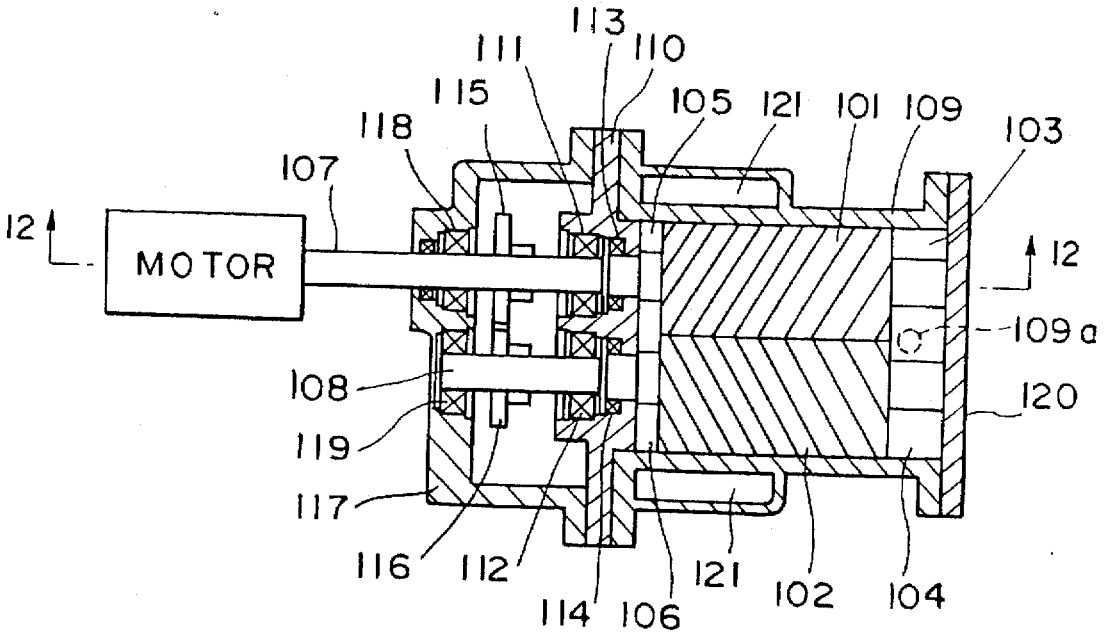
FIG. 11 is a cross-sectional view showing the screw vacuum pump in which the male and female rotors shown in FIGS. 9 and 10 are used.
Figure 12:
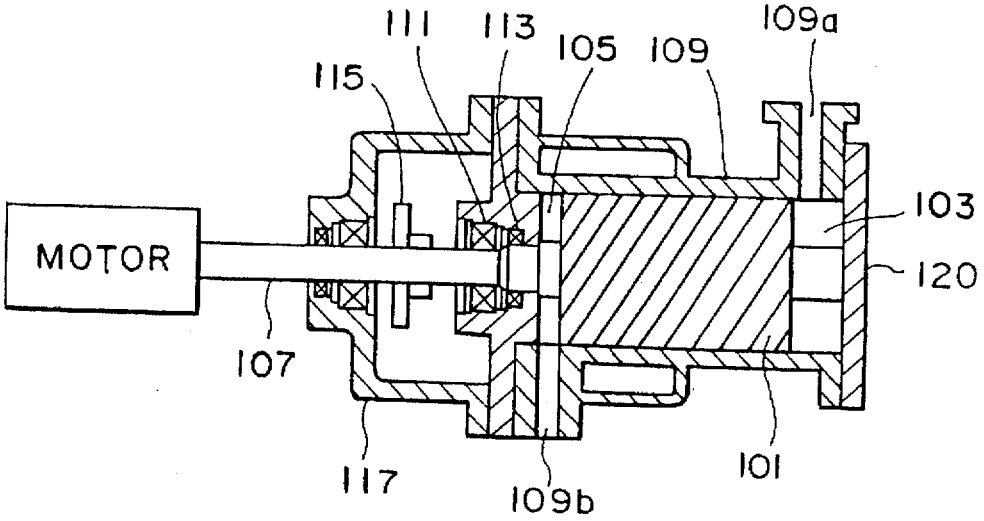
FIG. 12 is a cross-sectional view of the screw vacuum pump which is taken along a line A—A of FIG. 11.

FIG. 9 is a perspective view showing male and female rotors used in this embodiment, and FIG. 10 is a plan view showing the male and female rotors of FIG. 9. FIG. 11 is a cross-sectional view showing a screw vacuum pump using the male and female rotors shown in FIG. 10, and FIG. 12 is a cross-sectional view of the screw vacuum pump of FIG. 11 which is taken along a line A—A of FIG. 11.

As described above, each of the conventional male and female rotors is provided with a single screw gear. On the other hand, this embodiment is characterized in that each of the male and female rotors is provided with the screw gear as described above and a Roots.

As shown in FIGS. 9 and 10, a male (female) rotor 101 (102) comprises a screw gear portion 101*a* (102*a*), and male-side Roots portions 103 and 105 (female-side Roots portions 104 and 106). The male-side Roots portions 103 and 105 (female-side Roots portions 104 and 106) are formed at both ends of the screw gear portion 101*a* (102*a*).

Working rooms 101*b* (102*b*) which are formed by the screw gear portion 101*a* (102*a*) of the male (female) rotor 101 (102) and the casing intercommunicate with working rooms 103*a* (104*a*) which are formed by the male-side Roots portion 103 (female-side Roots portion 104) and the casing, and likewise the working rooms 101*b* (102*b*) intercommunicate with the working rooms 105*a* (106*a*) which are formed by the male-side Roots portion 105 (female-side Roots portion 106) and the casing. A rotational shaft 107 (108) is formed at one end portion of the male (female) rotor 101 (102).

Next, an arrangement state of the male and female rotors 101 and 102 in the casing will be described with reference to FIGS. 11 and 12.

As shown in FIGS. 9, 10, 11, 12 the male rotor 101 and the female rotor 102 are accommodated in a main casing 109, and these rotors are freely rotatably supported through bearings 111 and 112 which are secured to an end plate 110 for sealing one end surface of the main casing 109, and bearings 118 and 119 which are secured to an auxiliary casing 117.

A discharge port 109*b* for discharging to the outside gas which are compressed by the male and female rotors 101 and 102 is provided at the end plate 110 side of the main casing 109. Furthermore, seal members 113 and 114 are secured to each of the bearings 111 and 112, and these seal members 118 and 114 are used to prevent lubricant oil from invading into the working rooms from timing gears 115 and 116 as described later.

The timing gears 115 and 116 which are accommodated in the auxiliary casing 117 are secured to the rotational shafts 107 and 108 of the male and female rotors 101 and 102 to adjust the gap interval between the male and female rotors so that these rotors are not contacted with each other.

The bearings 111 and 112 are lubricated by oil splash, that is, lubricant oil (not shown) stocked in the auxiliary casing 117 is splashed to the bearings 111 and 112 by the timing gears 115 and 116. The auxiliary casing 117 is secured to the other end of the main casing 109, and a suck-in port 109*a* is secured to the other end side of the main casing 109.

In the screw vacuum pump thus constructed, as shown FIG. 9, 10, through rotation of the male and female rotors 101 and 102, gas is sucked from the suck-in port 109*a* into the working rooms 103*a* and 104*a* which are formed by the male-side Roots portion 103, the female-side Roots portion 104 and the casing. At the suck-in time, the sucked gas is compressed by the working rooms 103*a* and 104*a* of the Roots portions 103 and 104. The compressed gas is fed to the working rooms 101*b* and 102*b* which are formed by the casing and the screw gear portions 101*a* and 102*a* intercommunicating with the working rooms 103*a* and 104*a*. At an initial stage, the working rooms 101*b* and 102*b* feed the gas while keeping the volume thereof constant through the rotation of the rotors. However, when the rotors are further rotated, the volume of the working rooms 101*b* and 102*b* is reduced to compress the gas.

The compressed gas is further fed to the working rooms 105*a* and 106*a* of the male-side and female-side Roots portions 105 and 106 which intercommunicate with the working rooms 101*b* and 102*b*, and discharged from the discharge port 109*b* while compressed.

The temperature of the casing rises up due to gas compression, and thus a cooling jacket 121 is provided at the outside of the main casing 109 to cool the casing 109 and the compressed gas by supplying cooled water into the jacket 121.

Figure 13:
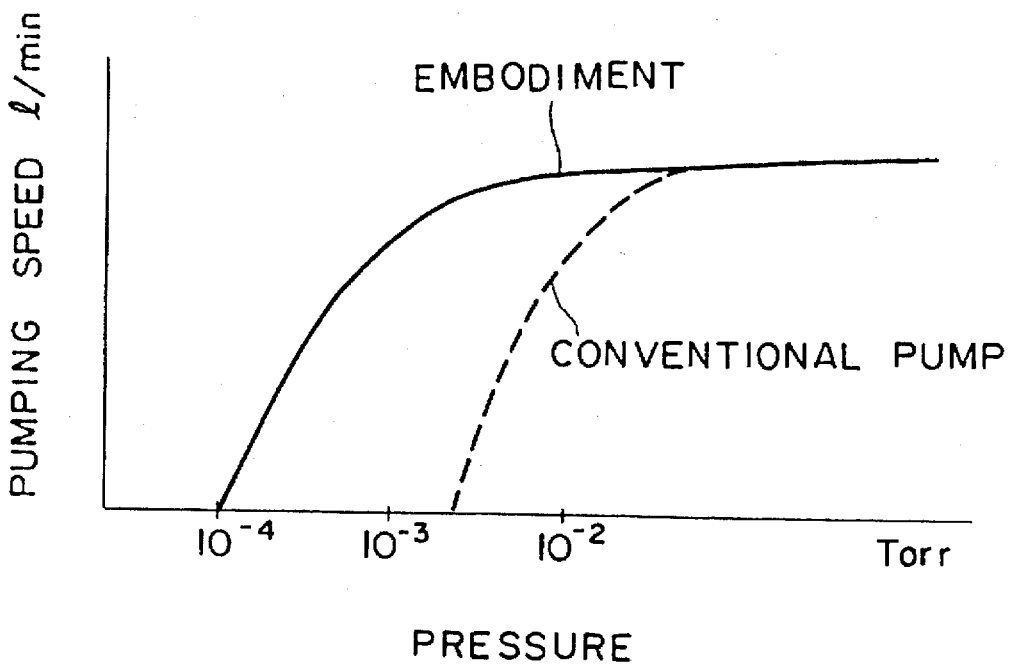
FIG. 13 is a diagram showing a pumping speed characteristic.

As described above, the screw fluid machine of this embodiment has both a screw pump function and a Roots pump function, and thus the pumping speed of the screw vacuum pump can be greatly improved as indicated by a solid line of FIG. 13. Therefore, evacuation from the atmospheric pressure (760 Torr) to a medium vacuum region of $10^{-4}$ Torr level can be effectively performed using only one vacuum pump at a stable pumping speed, and thus the working range can be broadened. Furthermore, when the pump of this embodiment is used as a compressor, a high discharge pressure can be obtained.

Figure 1:
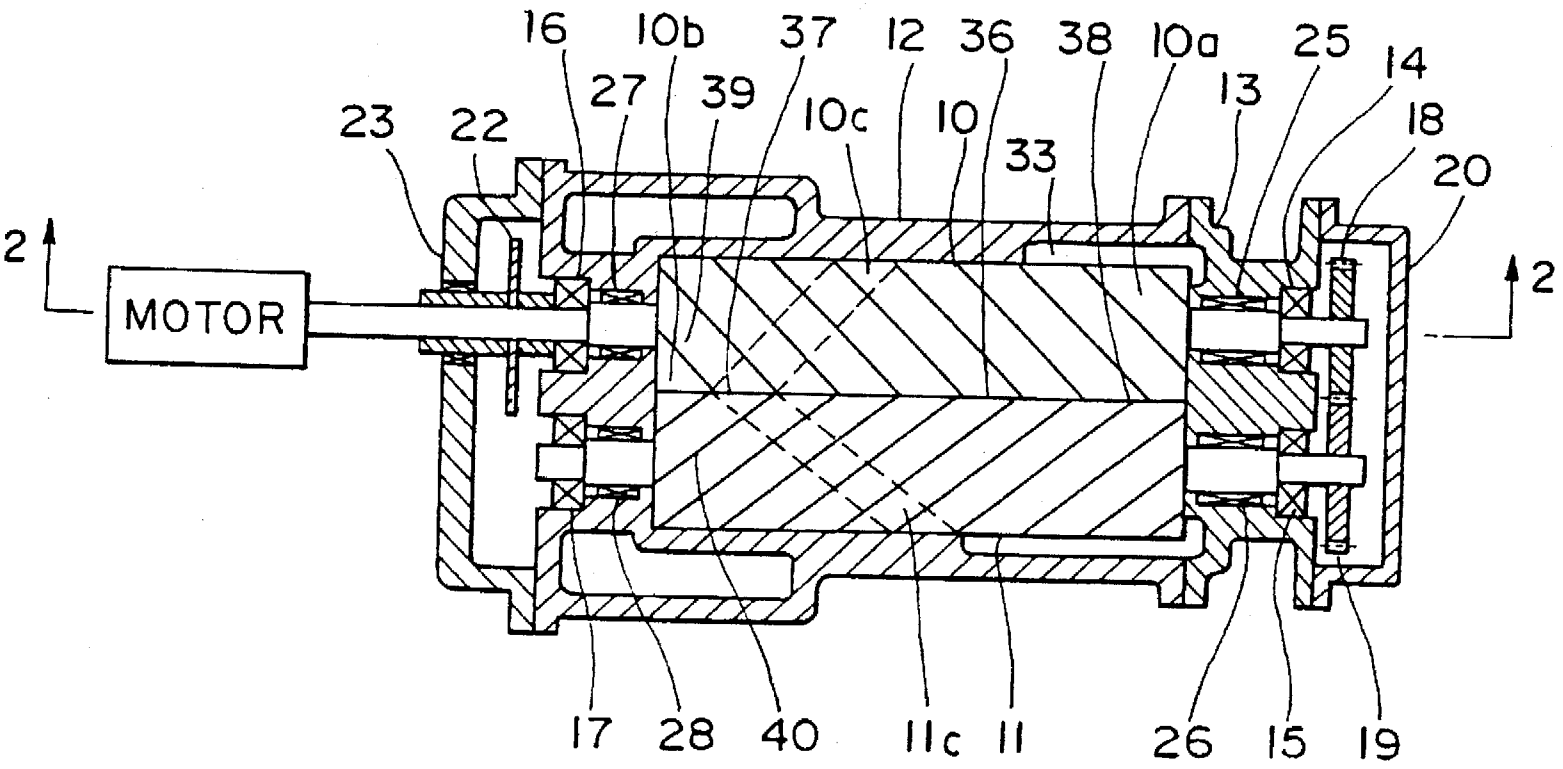
Fig. 1 PRIOR ART
FIG. 1 is a cross-sectional view showing a conventional screw vacuum pump, which is taken along a line B—B of FIG. 2.
Figure 2:
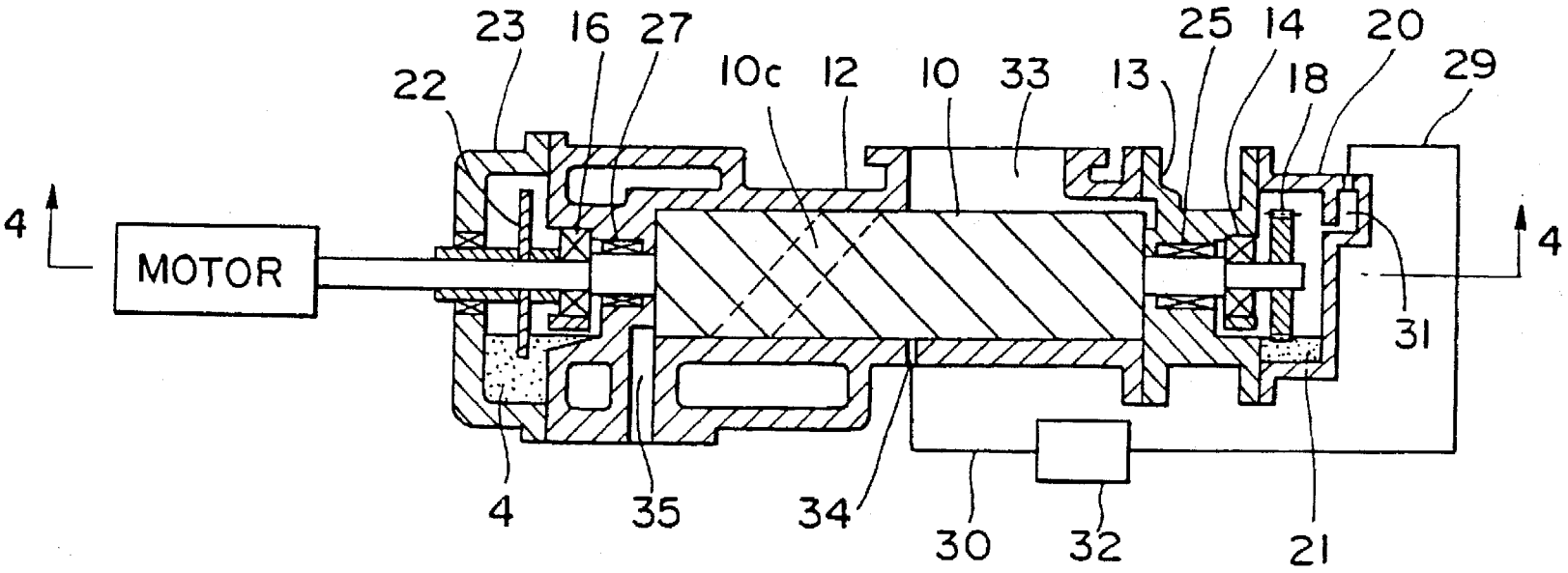
Fig. 2 PRIOR ART
FIG. 2 is a cross-sectional view showing the conventional screw vacuum pump of FIG. 1, which is taken along a line A—A of FIG. 1.
Figure 3:
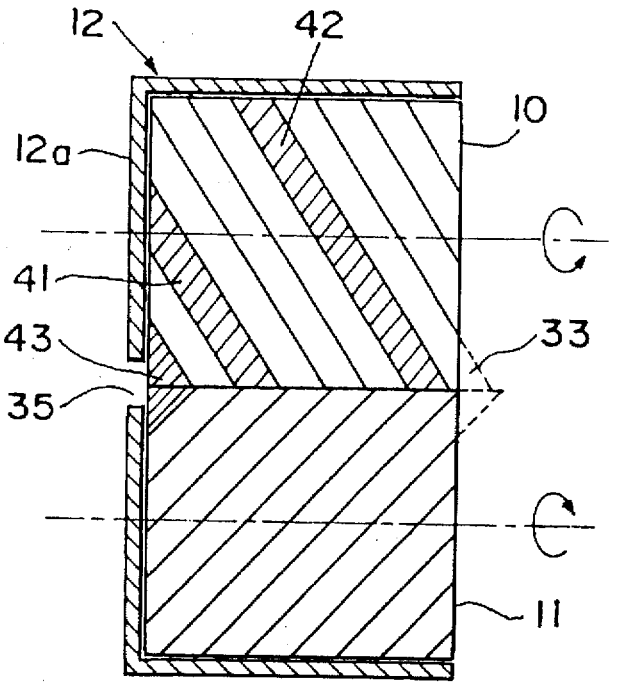
Fig.3 PRIOR ART
FIG. 3 is a schematic diagram showing an engagement state of male and female rotors of the conventional screw vacuum pump which is developed in a peripheral direction of the rotors.
Figure 4:
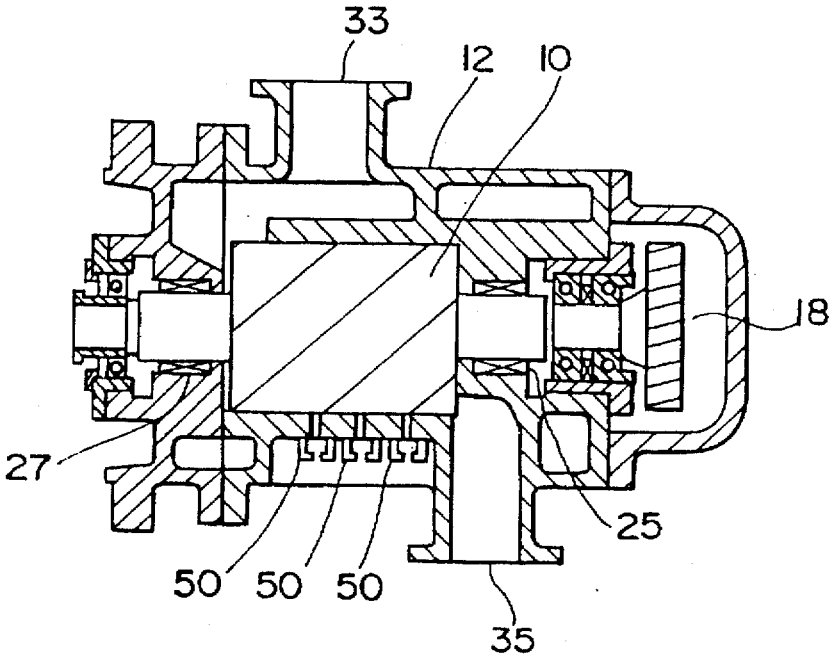
Fig.4 PRIOR ART
FIG. 4 is a cross-sectional view showing the conventional screw vacuum pump.

In the above embodiment, the Roots portion is provided at each of both ends of the screw gear portion, that is, it is provided at both the suck-in side and the discharge port. However, it may be provided at only one of these sides. Furthermore, in the above embodiment, the helix angle of the screw gear may be set to be continuously varied like the embodiment of FIGS. 6 and 7, or like the conventional one as shown in FIGS. 1 and 2.

Next, another embodiment in which the screw fluid machine of the present invention is used as a vacuum pump and a synchronizing rotation control is performed for the male and female rotors will be described with reference to FIGS. 14 to 16.

The screw vacuum pump of this embodiment basically has the same construction as the vacuum pump shown in FIGS. 11 and 12, except that no Roots portion is provided to male and female rotors 101 and 102, and motors $M_1$ and $M_2$ are secured to the rotational shafts 107 and 108 of the male and female rotors 101 and 102.

Figure 16:
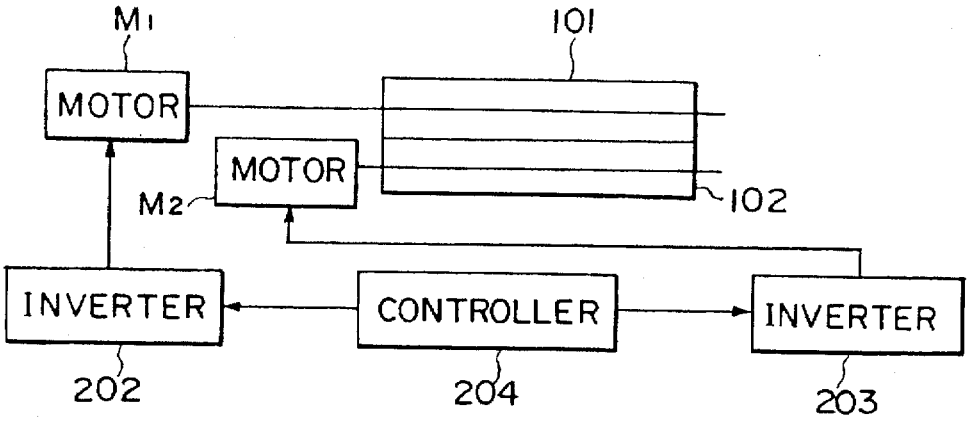
FIG. 16 is a circuit diagram to control the rotation of the male and female rotors shown in FIGS. 14 and 15.

FIG. 16 is a circuit diagram showing a control portion for the motors $M_1$ and $M_2$. As shown in FIG. 16, the motors $M_1$ and $M_2$ are connected to inverters 202 and 203 for transmitting a driving alternating signal or a driving pulse signal, and the inverters 202 and 203 are connected to a controller 204 for transmitting a control signal to perform a frequency-control.

When a control signal corresponding to a prescribed rotational number is transmitted from the controller 204 to the inverters 202 and 203, a driving alternating signal or driving pulse signal having a reference frequency corresponding to the control signal is transmitted from the inverters 202 and 203 to drive the motors $M_1$ and $M_2$ at the prescribed rotational number.

Next, the operation of the screw vacuum pump thus constructed will be described.

As described above, the control signal corresponding to the prescribed rotational number, that is, the control signal to control the frequency of the inverters 202 and 203 is transmitted from the controller 204 to the inverters 202 and 203. Upon receiving this control signal, the respective inverters 202 and 203 supply the corresponding motors $M_1$ and $M_2$ with the driving alternating signal or driving pulse signal having the prescribed frequency (reference frequency) corresponding to the control signal. The motors $M_1$ and $M_2$ are driven at the prescribed rotational number in response to the driving alternating signal or driving pulse signal.

In this case, if there is no error between the driving alternating signals or driving pulse signals which are transmitted from the respective inverters 202 and 203 for the motors $M_1$ and $M_2$ and these signals have the same prescribed frequency (reference frequency), the male and female rotors 101 and 102 are rotated in synchronism with each other, and thus the male and female rotors 101 and 102 are driven at the same rotational number, so that no load is applied to the timing gears 115 and 116. Accordingly, even when the male and female rotors 101 and 102 are rotated at a high speed, no load is applied to the timing gears 115 and 116, so that the noise due to the engagement of the timing gears can be suppressed.

With respect to ordinary inverters, there is a frequency error from 0.2 to 0.3%. Due to this frequency error of the inverters, the male and female rotors 102 and 102 cannot be rotated in perfect synchronism with each other, and some load is imposed on the timing gears 115 and 116 to rotate the male and female rotors 102 and 103 through the timing gears 115 and 116. However, this load is extremely smaller than that of the conventional vacuum pump, so that the noise due to the engagement of the timing gears 115 and 116 can be more suppressed as compared with the prior art. Furthermore, the tooth-face pressure of the timing gears is smaller than that in the prior art, and thus the high speed pumping operation can be performed. Therefore, the puming speed can be improved or the pump can be designed in a compact size.

Figure 17:
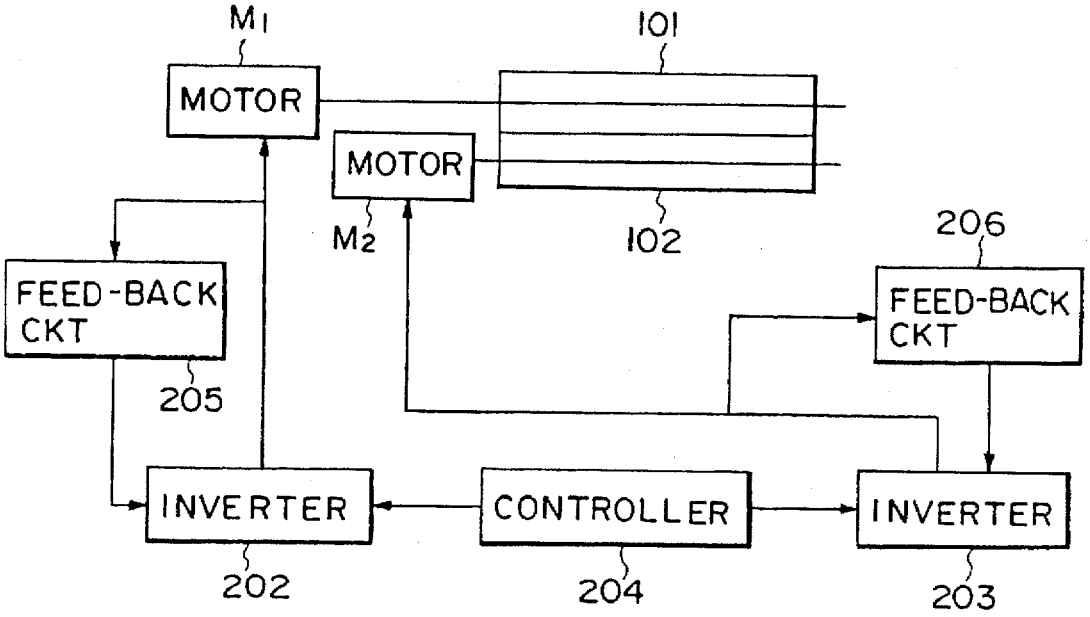
FIG. 17 is another circuit diagram to control the rotation of the male and female rotors.

Next, another embodiment of the control system for the motors will be described with reference to FIG. 17. The same elements as shown in FIG. 16 are represented by the same reference numerals.

Like the embodiment of FIG. 16, the motors $M_1$ and $M_2$ are connected to the inverters 202 and 203 for transmitting the driving alternating signal or driving pulse signal, and the inverters 202 sand 203 are connected to the controller 204 for transmitting a control signal to control the frequency of the inverters 202 and 203. This control system is further provided with feedback circuits 205 and 206 which receive the driving alternating signals or driving pulse signals from the inverters 202 and 203 respectively. Each of the feedback circuits 205 and 206 transmit a control signal to each of the inverters 202 and 203.

When a control signal corresponding to a prescribed rotational number is transmitted from the controller 204 to the inverters 202 and 203, a driving alternating signal or driving pulse signal having a prescribed frequency (reference frequency) is transmitted from each of the inverters 202 and 203 to each of the motors $M_1$ and $M_2$.

Here, if the driving alternating signal or driving pulse signal transmitted from each of the inverters 202 and 203 is deviated from the reference frequency due to a frequency error of the inverters 202 and 203 or the like, the male and female rotors 101 and 102 cannot be rotated in synchronism with each other. However, the driving alternating signal or driving pulse signal transmitted from each of the inverters 202 and 203 is input to each of the feedback circuits 205 and 206. Each of the feedback circuits 205 and 206 serves to correct the frequency error of each of the inverters 202 and 203, and supplies each of the inverters 202 and 203 with such a control signal that the frequency of each inverter 202, 203 is coincident with the reference frequency. As a result, the driving alternating signal or driving pulse signal which is transmitted from each of the inverters 202 and 203 gradually approaches to the reference frequency, and finally the male and the female rotors 101 and 102 are rotated in synchronism with each other.

As described above, even if there is any frequency error between the inverters 202 and 203, the feedback circuits 205 and 206 work to transmit the control signals from the feedback circuits to the inverters 202 and 203 so that the error is reduced. Therefore, the rotation of the male rotor 101 and the rotation of the female rotor 102 is synchronized with each other, so that the load applied to the timing gears 115 and 116 is gradually reduced and thus the noise due to the engagement of the timing gears can be suppressed.

In the above embodiment, the helix angle of the screw gear may be set to continuously vary or not to continuously vary, and furthermore, the Roots portion may be provided to the rotors.

Figure 14:
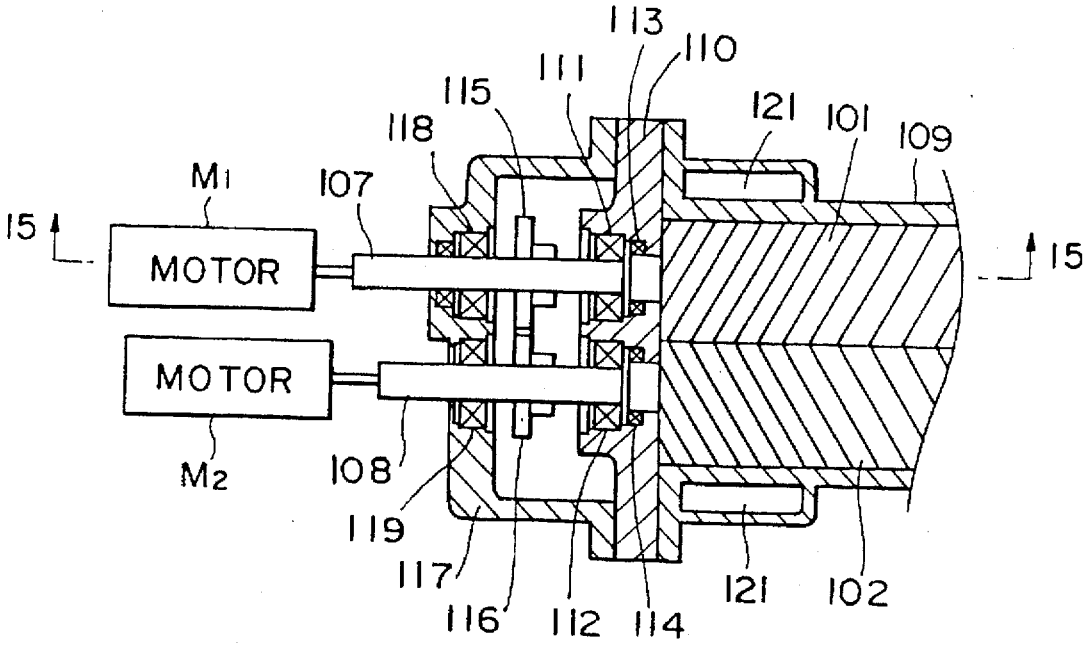
FIG. 14 is a cross-sectional view showing the screw vacuum pump of a second embodiment of the present invention.
Figure 15:
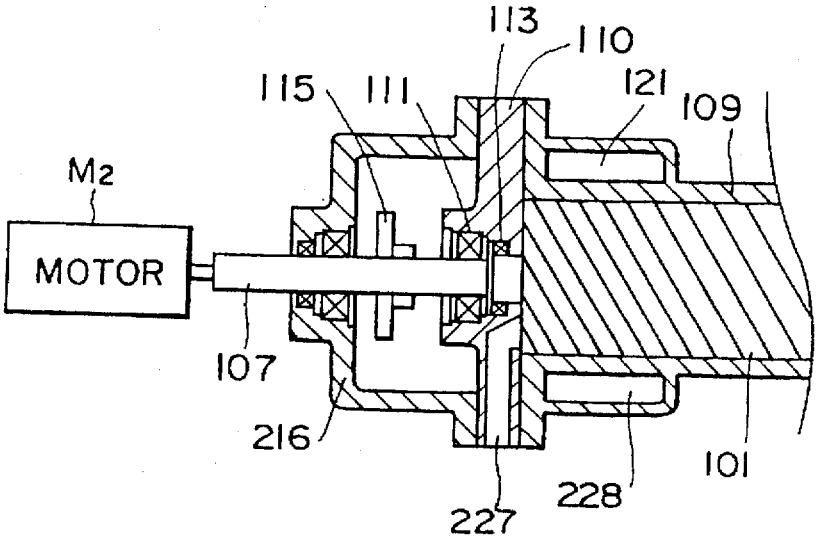
FIG. 15 is a cross-sectional view of the screw vacuum pump which is taken along a line A—A of FIG. 14.
Figure 18:
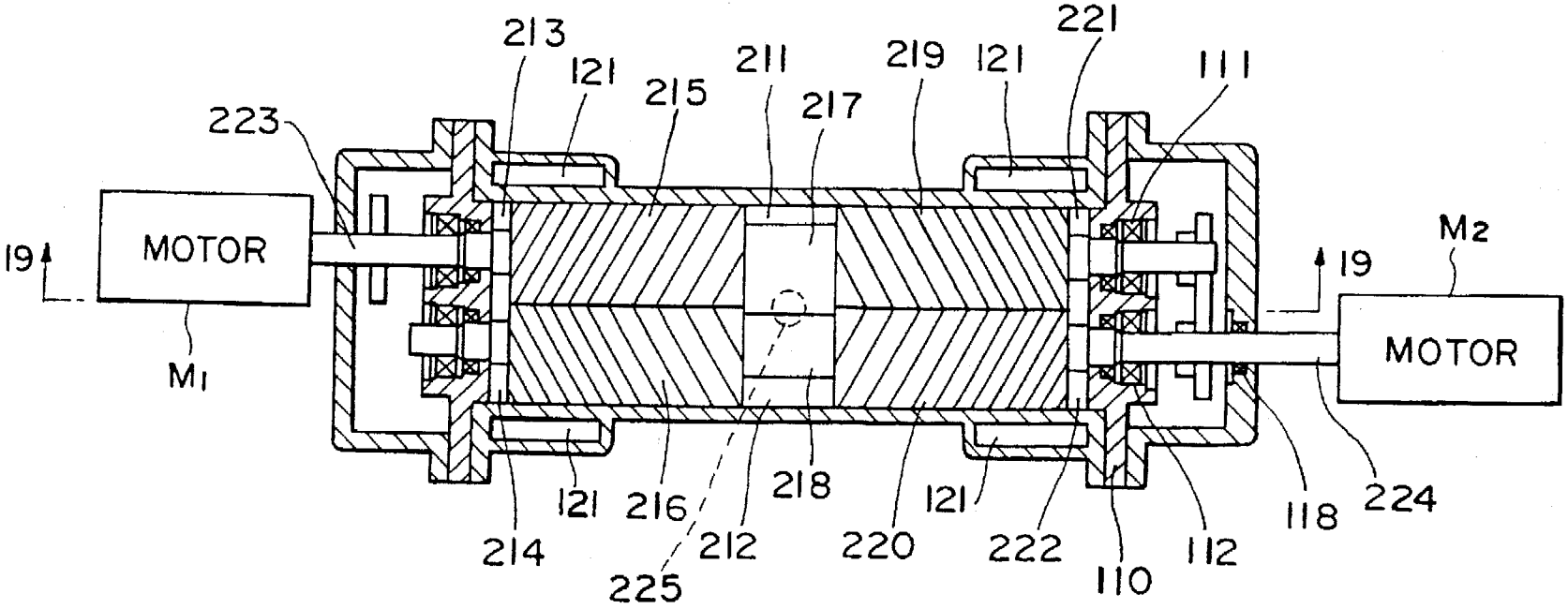
FIG. 18 is a cross-sectional view showing a screw vacuum pump of a third embodiment of the present invention.
Figure 19:
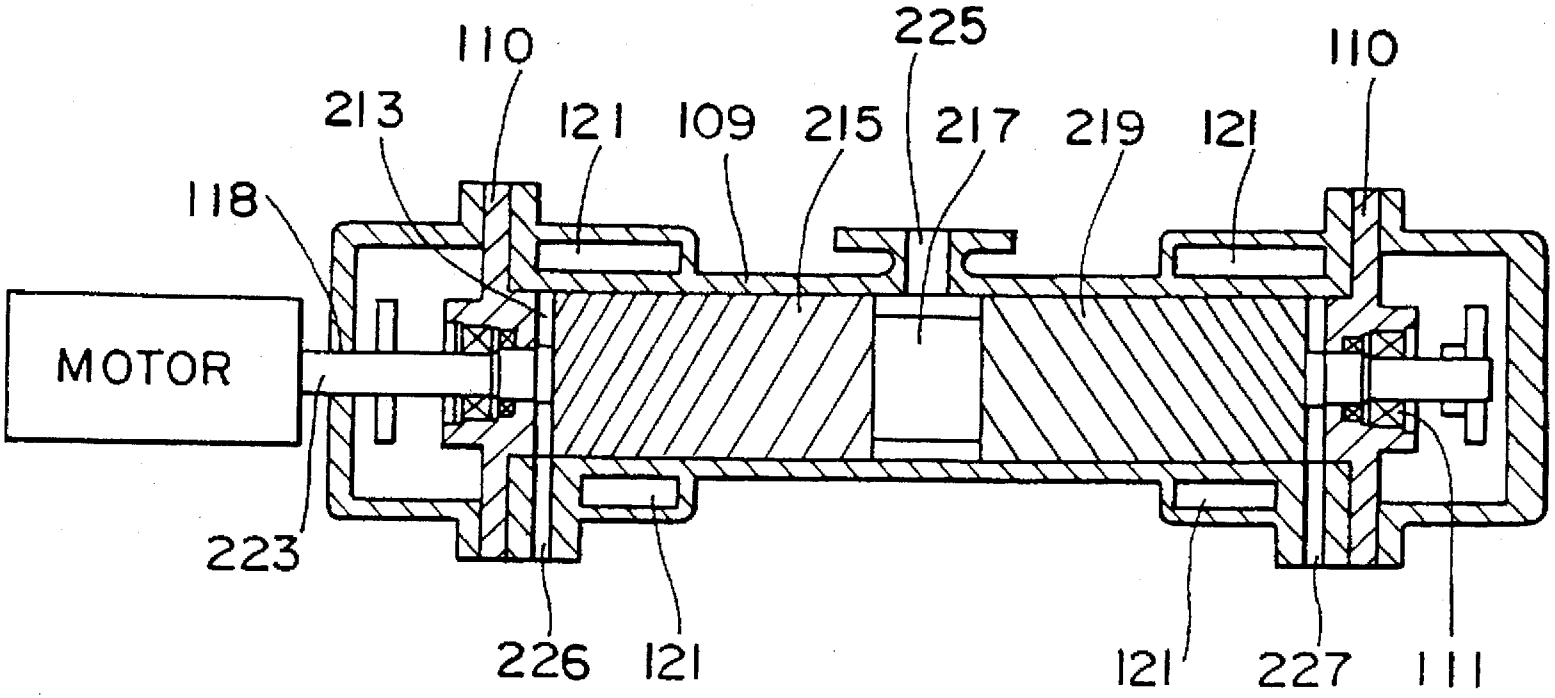
FIG. 19 is a cross-sectional view of the screw vacuum pump which is taken along a line A—A of FIG. 18.

FIGS. 18 and 19 are diagrams showing a improved modification of the vacuum pump shown in FIGS. 14 and 15. The vacuum pump of this modification is provided with Roots portions 213 and 214, screw portions 215 and 216, Roots portions 217 and 218, screw portions 219 and 220 and Roots portions 221 and 222 in this order from the left side to the right side in the rotational axial direction. The motors $M_1$ and $M_2$ which are controlled in the same manner as described above are secured to one end sides of rotational shafts 223 and 224, respectively.

By this arrangement of the motors $M_1$ and $M_2$, the motors $M_1$ and $M_2$ can be easily secured to the rotational shafts 223 and 224 even when the motors $M_1$ and $M_2$ have a large diameter. The respective paris of right and left screws 215, 216, 219 and 220 which are provided on the same axial line are designed to have opposite helixes so that the gas sucked from the suck-in port 225 is branched into two parts in the right and left directions and then discharged from the discharge ports 226 and 227, respectively. The other construction is similar to that of FIGS. 14 and 15. Accordingly, the same elements as FIGS. 14 and 15 are represented by the same reference numerals, and the description thereof is omitted.

Next, an embodiment in which a pressure adjusting valve is provided to the vacuum pump of the present invention will be described with reference to FIGS. 20 to 22.

Figure 20:
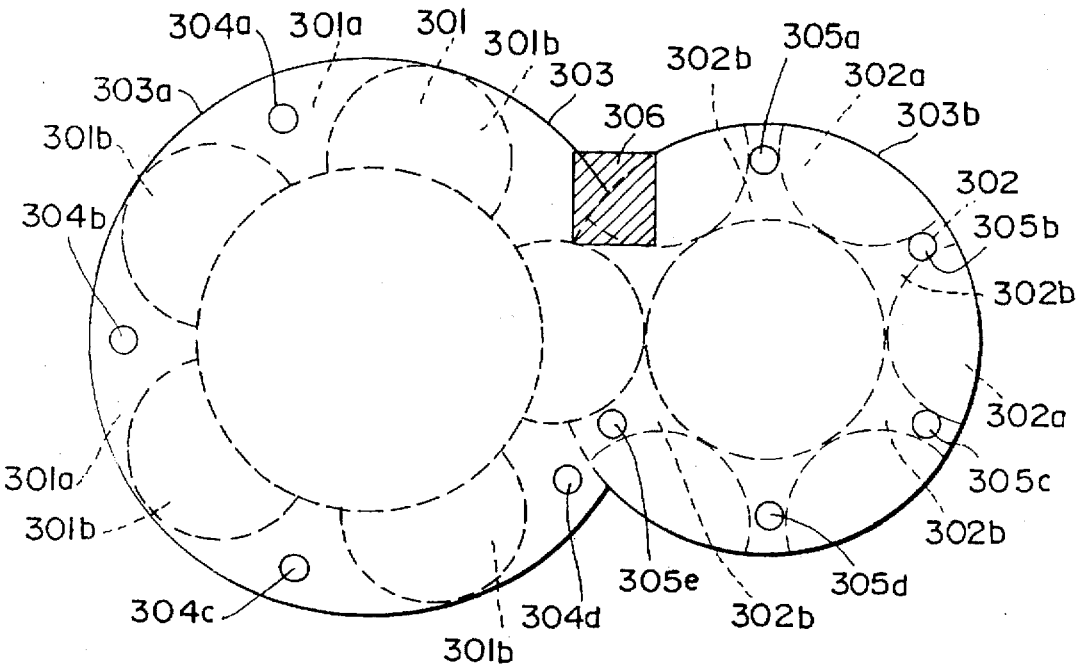
FIGS. 20*a* & *b* is a schematic diagram showing a screw vacuum pump of a fourth embodiment of the present invention which is viewed from the discharge side of the casing.
Figure 20:
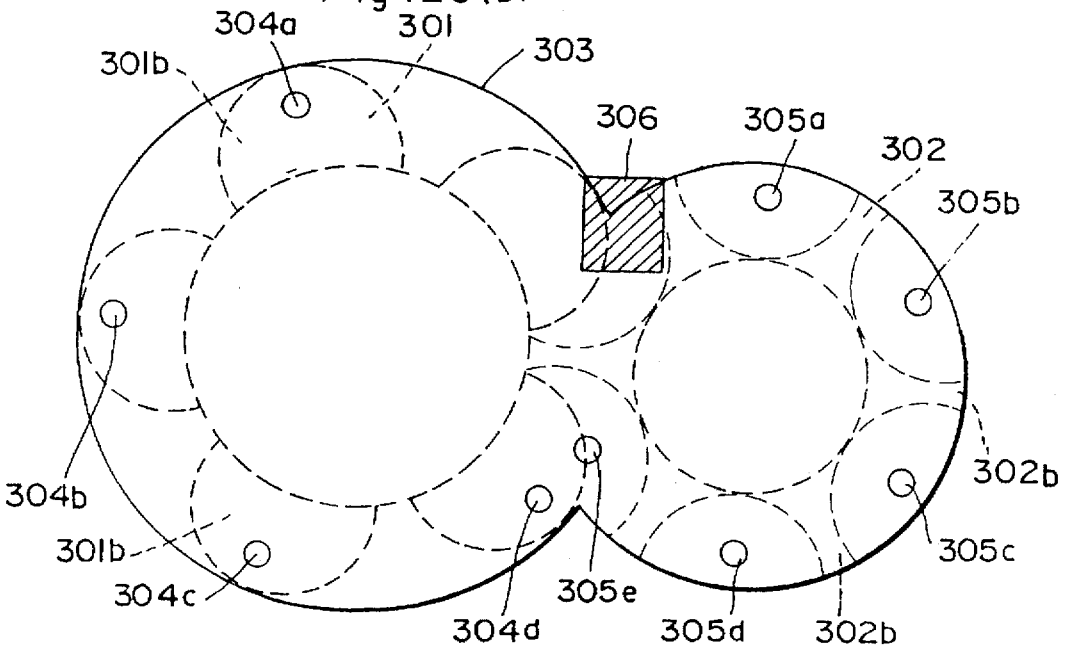
Figure 21:
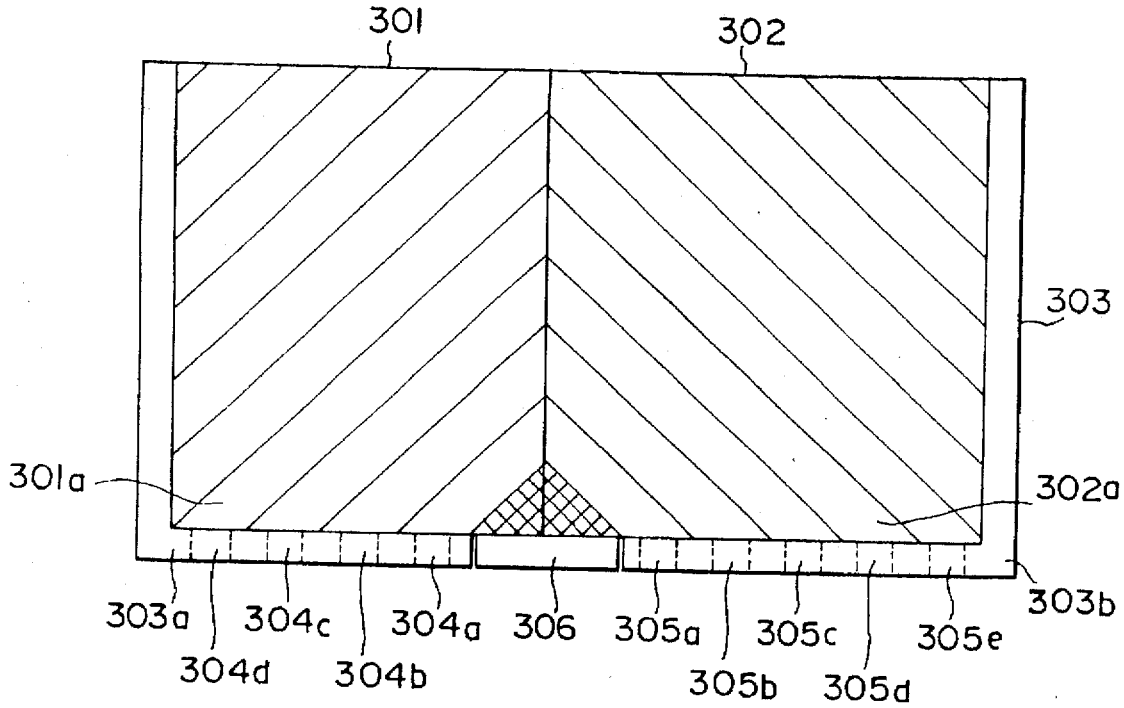
FIG. 21 is a schematically shows the screw vacuum pump of the embodiment in which the rotors are developed in the peripheral direction thereof.

FIG. 20 is a schematic diagram showing a discharge-side end face plate portion (inner wall surface portion) of the casing of the screw vacuum pump, which is viewed from the rotor side. In FIG. 20, (a) shows a state where the tooth end surface of the male rotor is not located at the discharge port of the male rotor side, and (b) shows a state where the tooth end surface of the male rotor is located at the discharge port because the male rotor is rotated. FIG. 21 is a schematic diagram of the screw vacuum pump which is developed in the peripheral direction of the rotors, and FIG. 22 is an enlarged view showing a main portion of the discharge port.

As shown in these figures, a male rotor 301 and a female rotor 302 are accommodated in a casing 303 like the conventional screw vacuum pump.

A male rotor end face plate 303*a* and a female rotor end face plate 303*b* (in FIG. 21) are formed at the discharge side of the casing 303. The end face plate 303*a* and the end face plate 303*b* are not contacted with the tooth end face of the male rotor 301 and the tooth end face of the female rotor 302, and these plates are disposed away from these rotors at minute gap intervals. Accordingly, the gas tightness of working rooms 301*a* and 302*a* are kept by the male and female rotor end face plates 303*a* and 303*b* and the tooth end faces 301*b* and 302*b* of the male and female rotors 301 and 302.

Furthermore, discharge ports 304*a*, 304*b*, 304*c* and 304*d* are formed on the end face plate 303*a* of the male rotor 301, and also discharge ports 305*a*, 305*b*, 305*c*, 305*d*, 305*e* are formed on the end face plate 303*b* of the female rotor. In addition, a discharge port 306 is formed at the upper portions of the end face plate 303*a* and the end face plate 303*b* while extend over these end face plates 303*a* and 303*b*.

There are provided four discharge ports 304 on the male rotor side end face plate 303*a*, whose number is smaller than the number of teeth (five in this embodiment) of the male rotor by one, and the four discharge ports 304*a* to 304*d* are arranged at the same interval as the tooth pitch of the screw gear constituting the male rotor 301 on the pitch circle of the screw gear.

Since the discharge ports are formed at the same interval as the tooth pitch of the screw gear constituting the male rotor 301, five discharge ports can be provided on the male rotor side end face plate 303*a*, and the fifth discharge port is formed as being used as the discharge port 306. Accordingly, the discharge ports 304*a* to 304*d* are respectively formed at angular positions of 72, 144, 216 and 288 with respect to the discharge port 306.

Like the male rotor side end face plate 303*a*, five discharge ports 305 are provided on the female rotor side end face, the number of five is smaller than the number of teeth of the female rotor (six in this embodiment). The five discharge ports 305*a* to 305*e* are arranged at the same interval as the tooth pitch of the screw gear constituting the female rotor 302 on the pitch circle of the screw gear.

As described above, the discharge ports are formed at the same interval as the tooth pitch of the screw gear constituting the female rotor 302, and thus six discharge ports can be provided on the female rotor side end face plate 303*b*. The sixth discharge port is designed to be used as the discharge port 306. Accordingly, the discharge ports 305*a* to 305*e* are respectively formed at angular positions of 60°, 120°, 180°, 240° and 300° with respect to the discharge port 306.

The discharge ports 304*a* to 304*d* and the discharge ports 305*a* to 305*e* are formed in the positional relationship as described above. Therefore, when the end face 301*b* of the screw gear of the male rotor 301 is kept not to close the discharge ports 304*a* to 304*d* as shown in (a) of FIG. 20 (the end face 302*b* of the screw gear of the female rotor 2 closes the discharge ports 305*a* to 305*e*), the discharge ports 304*a* to 304*d* is kept in an open state while the discharge ports 305*a* to 305*e* is kept in a close state.

When the rotors are rotated, the above state is shifted to such a state as shown in (b) of FIG. 20 where the end face 301*b* of the screw gear of the male rotor 301 closes the discharge ports 304*a* to 304*d* (the end face 302*b* of the screw gear of the female rotor 2 does not close the discharge ports 305*a* to 305*e*). In any case, the working rooms do not intercommunicate with each other through the discharge ports 304 and 305.

Figure 5:
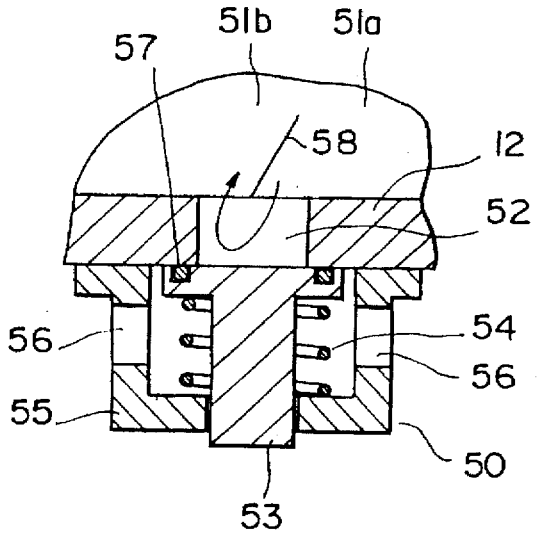
Fig. 5 PRIOR ART
FIG. 5 is a cross-sectional view showing a main part of a pressure adjustment device shown in FIG. 4.

Next, the discharge valve provided at the outside of the discharge ports will be described with reference to FIG. 22. The discharge valve of this embodiment has the same basic construction as the conventional discharge valve, and the same elements as shown in FIG. 5 are represented by the same reference numerals.

Figure 22:
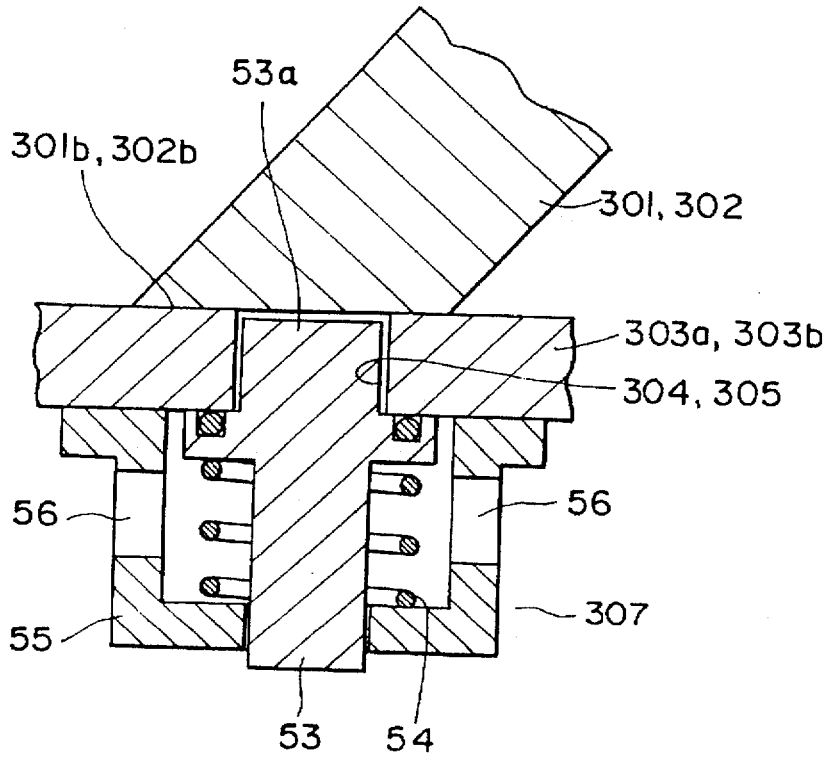
FIG. 22 is an enlarged view showing a main portion of the discharge port.

In FIG. 22, a pressure adjustment device 307 includes a valve rod 53 for opening and closing each discharge port as described above, a projection portion 53*a* which is formed integrally with the valve rod 53 on the opposite surface to the valve rod 53 and inserted into the discharge port (304, 305), a spring 54 for urging the discharge port (304, 305) in such a direction as to close the discharge port (304, 305), a valve box 55 for accommodating the valve rod 53 and the spring 54, and an air open port 56 which is formed in the valve box 55 and serves to discharge to the outside gas which is emitted from the discharge ports 304, 305.

The urging force of the spring 54 is adjusted to such a value that in a case where the screw pump is disposed in a vertical direction with its discharge port 306 placed face down, the discharge ports 304, 305 are opened when the pressure in the working rooms increase to the atmospheric pressure or more, that is, the dead weight of the valve rod 53 can be supported. Accordingly, in a case where the pump is disposed in a horizontal direction, the discharge ports 304, 305 are opened when the pressure in the working rooms exceeds the sum of the atmospheric pressure and the urging force of the spring 54 (this value is regarded as being substantially equal to the atmospheric pressure because the urging force of the spring is small).

The operation of the screw vacuum pump as described above when it is disposed with the discharge ports placed face down will be described.

First, when the pressure of the suck-in gas is low and the pressure of a working room 301*a* is lower than the atmospheric pressure, the valve rod 53 in the valve box 55 is urged by the spring 54 to close the discharge port (304, 305). At this time, the projection portion 53*a* is inserted into the discharge port (304, 305), only a slight gap is formed in the discharge port (304, 305). Therefore, when the working rooms 301*a* and 302*a* are located at the discharge ports 304, 305 and intercommunicate with these discharge ports, the pressure of the working rooms 301*a* and 302*a* is not affected by the pressure in the gap of each discharge port (304, 305).

Accordingly, the gas which is sucked in through the suck-in port enters the working rooms 301*a* and 302*a* which are formed by the male rotors 301, the female rotors 302 and the casing 303, compressed through the rotation of both the rotors, and then discharged from the discharge port 306 without being discharged from the pressure adjusting device to the outside. At this time, the inside of the discharge ports 304, 305 are designed to be closed by the tooth end face 301*b* or 302*b* of the screw gear constituting the rotor, so that a working room does not intercommunicate with an adjacent working room. Therefore, it can be prevented that the gas leaks from a high-pressure working room to a low-pressure working room and thus it takes a long time to evacuate the suck-in side at a desired vacuum degree.

On the other hand, when the pressure of the suck-in gas is high and the pressure of the working room is higher than the atmospheric pressure, the valve rod 53 is pushed down, and the gas in the working room passes from the discharge port (304, 305) through the gap in the valve box 55 and the air open port 56 to the outside.

Thereafter, when the suck-in pressure is lowered and the pressure in the working room concerned does not reach the atmospheric pressure just before the working room intercommunicates with the discharge port, all the discharge ports 304 and 305 of the pressure adjusting devices are closed, and the gas in the working room is discharged from the discharge port 306 under pressure without being discharged from the pressure adjusting device 307 to the outside.

As described above, according to the screw vacuum pump of this embodiment, through the rotation of the rotors of the screw vacuum pump, the insides of the discharge ports are closed by the end tooth faces of the rotors in a state where the tooth end faces of the rotors are located at the discharge ports. Therefore, a working room can be prevented from intercommunicating with an adjacent working room through the discharge ports, and no gas leaks from a high-pressure working room to a low-pressure working room, so that it does not take a long time to evacuate the suck-in side at a desired vacuum degree.

Furthermore, the pressure in the working rooms are suppressed to a value below the atmospheric pressure at all times, so that excessive compression is not carried out even when the vacuum pump is operated in a state where the suck-in pressure is substantially equal to the atmospheric pressure, Therefore, increase of shaft torque can be prevented, and thus power consumption can be suppressed.

In addition, since excessive compression is not carried out, the temperature of the screw vacuum pump can be prevented from rising up abnormally, and the dimensional precision of the engagement between the casing and the rotors and the engagement between the male and female rotors, etc. can be kept excellent.

In the above embodiments, the screw vacuum pump is provided with the four or five discharge ports. However, the number of the discharge ports is not limited to a specific one, and it may be suitably selected in consideration of its use range, its performance, etc.

Furthermore, the discharge ports are located at the position corresponding to the pitch circle of the screw gear of the rotor. However, the location position of the discharge ports is not limited to this position, and these may be located at such a position that these discharge ports can be closed by the tooth end face of the screw gear.

In the above embodiments, the urging force of the spring is set to the extent that the dead weight of the valve rod 53 can be supported by the spring. However, it is not limited to this degree, and it may be altered in consideration of the use range, performance, etc. of the screw vacuum pump.

Furthermore, in the above embodiments, the helix angle of the screw gear may be continuously altered or not continuously altered. In addition, the Roots portion may be provided at the discharge side of the screw portion of the rotor as shown in FIGS. 11 and 12 (the discharge-side end face corresponds to the tooth end face).

As is apparent from the forgoing, according to the screw fluid machine, the tooth-trace helix angle of each of the male and female rotors is designed to vary in its helix direction. Therefore, the volume of each of the V-shaped fluid working rooms which are formed by the rotors and the casing can be continuously increased or decreased in accordance with the rotational angle of the rotors. As a result, the abnormal local rise-up of the temperature can be suppressed, so that the dimensional precision of the engagement between the casing and the rotors and the engagement between the male and female rotors can be improved.

Furthermore, the following screw gear is usable for the screw fluid machine according to the present invention. That is, the screw gear of this invention is characterized in that the peripheral length of the pitch cylinder in the helix advance direction on the development of the tooth-trace rolling curve on the pitch cylinder of the screw gear can be expressed by a substantially monotonically increasing function. With this screw gear, the sealing property in the plane-of-rotation direction can be improved, and thus the gas tightness of the fluid working rooms can be improved.

In addition, the screw gear thus constructed can be used as an ordinary transmission gear, and in addition it can effectively treat any load which is varied in the axis direction with time variation because the helix angle is varied with time variation through rotation.

According to the fluid machine of the present invention, the Roots portion is provided to at least one end side of the screw portion of the male and female rotors. Therefore, when the fluid machine is used as a vacuum pump, the pumping speed can be greatly improved, and the evacuation operation from the atmospheric pressure to the medium vacuum area of $10^{-4}$ Torr level can be effectively performed using only one vacuum pump at a stable pumping speed. In addition, when the fluid machine of the present invention is used as a compression pump, a high discharge pressure can be obtained.

Furthermore, according to the fluid machine of the present invention, the male and female rotors are rotated in synchronism with each other. Therefore, even when the rotors are rotated at a high speed, the noise occurring through the engagement of the timing gears can be suppressed.

Still furthermore, according to the fluid machine of the present invention, through the rotation of the rotors, the insides of the discharge ports are closed by the tooth end faces of the rotors in the state where the tooth end faces of the rotors are located at the discharge ports. Therefore, a working room can be prevented from intercommunicating with another adjacent working room through the discharge ports. As a result, gas can be prevented from leaking from a high-pressure working room to a low-pressure working room, and no surplus (long) time is needed until the suck-in side is evacuated to a desired vacuum degree.

According to the fluid machine of the present invention, the pressure in the working rooms are reduced to the atmospheric pressure or less. Therefore, even when the fluid machine is operated in the state where the suck-in pressure is substantially equal to the atmospheric pressure, the increase of the shaft torque due to excessive compression can be prevented, and thus the power consumption can be reduced. In addition, the abnormal increase of the temperature of the screw vacuum pump can be prevented because of no excessive compression, and thus the dimensional precision of the engagement between the casing and the rotors and the engagement between the male and female rotors.

What is claimed is:

1. A screw fluid machine including male and female rotors, a casing for accommodating said male and female rotors, fluid working rooms which are formed by said male and female rotors and said casing, fluid inlet and outlet ports which are provided in said casing so as to intercommunicate with one end portion and the other end portion of said fluid working rooms, the improvement in which each of said male and female rotors is provided with a Roots portion, a screw gear portion and a Roots portion from a fluid inlet side toward a fluid outlet side in this order.

* * * * *